US005962981A

United States Patent [19]

Okude et al.

[11] Patent Number: 5,962,981

[45] Date of Patent: Oct. 5, 1999

[54] DISCHARGE LAMP LIGHTING DEVICE

[75] Inventors: Akio Okude; Kouji Noro; Naoki Komatsu, all of Kadoma, Japan

[73] Assignee: Matsushita Electric Works, Ltd., Osaka, Japan

[21] Appl. No.: 08/865,608

[22] Filed: May 29, 1997

[30] Foreign Application Priority Data

Apr. 18, 1997 [JP] Japan ..... 9-102213
Apr. 18, 1997 [JP] Japan ..... 9-102214

[51] Int. Cl.[6] ..... H05B 37/00

[52] U.S. Cl. ..... 315/128; 315/209 R; 315/308; 315/224; 315/244; 315/282; 315/DIG. 5; 315/DIG. 7

[58] Field of Search ..... 315/243, 225, 315/226, 224, 291, 244, 282, 127, 128, 247, 308, DIG. 2, DIG. 5, DIG. 7, 209 R

[56] References Cited

U.S. PATENT DOCUMENTS

| | | | |
|---|---|---|---|
| 4,328,446 | 5/1982 | Fallier, Jr. et al. | 315/47 |
| 4,412,156 | 10/1983 | Ota | 315/308 |
| 4,734,624 | 3/1988 | Nagase et al. | 315/243 |
| 5,151,631 | 9/1992 | Oda et al. | 315/127 |
| 5,212,428 | 5/1993 | Sasaki et al. | 315/308 |
| 5,434,474 | 7/1995 | Ukita et al. | 315/128 |

FOREIGN PATENT DOCUMENTS 6-295790 10/1994 Japan .

*Primary Examiner*—Haissa Philogene
*Attorney, Agent, or Firm*—Lynn & Lynn

[57] ABSTRACT

A discharge lamp lighting device which comprises a DC power source for generating a voltage necessary for a discharge lamp from a DC power source, a control circuit for calculating a power required by the discharge lamp to perform feedback control over the DC power source, a polarity switching circuit for switching polarities of an output of the DC power source to apply the output to the discharge lamp, an ignitor for superposing a high pulse voltage to the discharge lamp at the time of starting the discharge lamp, and a capacitor which forms a closed circuit together with the ignitor, wherein, in order to suppress excessive charging and discharging currents flowing through the capacitor when the polarities of the polarity switching circuit are switched, the control circuit controls the polarity switching circuit to be operated at a low frequency and simultaneously be chopper-operated at a high frequency. Thereby the excessive current flowing through switching elements at the time of switching the polarities can be suppressed and stresses imposed on the switching elements can be sufficiently prevented.

6 Claims, 23 Drawing Sheets

DISCHARGE LAMP LIGHTING DEVICE

BACKGROUND OF THE INVENTION

The present invention relates to discharge lamp lighting devices and more particularly, to a discharge lamp lighting device for lighting a high-pressure discharge lamp requiring application of a high pulse voltage thereto in a start mode, such as a high-pressure sodium lamp, a metal halide lamp or a high-pressure mercury lamp.

DESCRIPTION OF RELATED ART

There is provided a prior art discharge lamp lighting device for lighting this sort of high-pressure discharge lamp, which comprises a DC power source, a discharge lamp, a voltage step-down chopper circuit for converting power voltage of the DC power source to a power necessary for the discharge lamp, first and second resistors for detecting a lamp voltage applied to the discharge lamp, a resistor for detecting a lamp current flowing through the discharge lamp, and a feedback control circuit for controlling switching elements in the DC power source. In this case, the discharge lamp lighting device calculates the power necessary for the discharge lamp on the basis of the lamp current detected by the lamp-current detecting resistor and the lamp voltage detected by the first and second resistors for detection of the lamp voltage, and performs feedback control over a voltage step-down chopper circuit to output the necessary power. Further, for the purpose of preventing an acoustic resonance phenomenon of the discharge lamp by means of a polarity switching circuit to stabilize discharging arc and preventing a cataphoresis phenomenon causing color separation in a light emitting area, the lighting device is arranged to supply a rectangular wave AC power having a low frequency to the discharge lamp. And the polarity switching circuit, which comprises a full bridge circuit made up of 4 switching elements and 4 parasitic diodes reversely (i.e., in their reverse-bias direction) connected in parallel to these switching elements, is driven by a low frequency drive circuit so that two pairs of the diagonally coupled switching element pairs are alternately turned ON and OFF to invert the polarities of a voltage to be applied to the discharge lamp. The prior art lighting device further includes an ignitor for starting the discharge lamp as superimposed by a high pulse voltage. The ignitor, which has a trigger circuit as a pulse voltage generator and a pulse transformer for boosting the pulse voltage, is arranged to superimpose a high pulse voltage to the discharge lamp through a capacitor which forms a closed circuit for application of the high pulse voltage.

With the aforementioned arrangement, the capacitor functions to apply the high pulse voltage to the discharge lamp and also acts as a power supply for supply a forced discharge current to quickly transit glow discharge to arc discharge immediately after the discharge lamp starts its discharging operation. Taking the above function into consideration, in order to improve a start performance of the discharge lamp, it is effective to increase the capacitance of the capacitor to thereby increase the forced discharge current immediately after the discharge start of the lamp. However, the presence of the capacitor also involves such a problem that, in particular at the time of polarity switching operation to put out the discharge lamp, an excessive current flows through the respective switching elements to cause erroneous operation of the device. In particular, when the capacitance of the capacitor is increased, the above problem becomes serious.

Also already proposed is another prior art invention disclosed in U.S. Pat. No. 4,412,156, which includes a circuit configuration similar to the aforementioned prior art arrangement. This invention is substantially the same in the arrangements of the voltage step-down chopper and polarity switching circuit, but has such a problem that, since the polarity switching circuit fails to contain such a capacitor as mentioned above, it is impossible to secure its discharge start performance.

A further prior art including substantially the same circuit arrangement as the aforementioned prior art arrangement is disclosed in U.S. Pat. No. 4,734,624. This invention include a capacitor as in the above prior art arrangement, but functions to supply an oscillation current to a discharge lamp in such a manner that the lit state of the discharge lamp is kept during OFF state of all switching elements at the time of polarity switching operation. Thus, since the values of the capacitor and inductor are set so that the oscillation current flows into the discharge lamp during the OFF state of all the switching elements, the setting of the capacitance of the capacitor can be effected with less flexibility and thus with a risk of less securing the start performance of the discharge lamp. Meanwhile, there still remains a problem that the incorporation of the capacitor though small in capacitance causes an excessive current to flow through the switching elements to charge and discharge the capacitor at the time of the polarity switching operation to put out the discharge lamp as in the invention of U.S. Pat. No. 4,412,156.

Yet another prior art is disclosed in Japanese Patent Application Laid-Open Publication No. Hei-6-295790. This prior art invention is arranged, when a lamp impedance is low immediately after starting the discharging operation of a discharge lamp, to detect and suppress an excessive current flowing through the discharge lamp. In other words, only during flowing of the excessive current through the discharge lamp at the time of starting the discharge lamp, switching elements in a polarity switching circuit are chopper-operated at a high frequency to suppress the above excessive current. In this invention, however, there is a problem that the excessive current for charging and discharging the capacitor cannot be effectively suppressed at the time of the polarity switching operation to put out the discharge lamp.

SUMMARY OF THE INVENTION

It is therefore a major object of the present invention to provide a lighting device for a high-pressure discharge lamp, which eliminates the above problems in the prior arts and wherein, at the time of putting out the discharge lamp, a charging/discharging current flowing through a capacitor forming a closed circuit for application of a high pulse voltage causes suppression of an excessive current flowing through switching elements at the time of polarity switching operation to thereby prevent stress of the switching elements and to achieve stable operation of the discharge lamp lighting device. Another object of the present invention is to realize a discharge lamp lighting device which detects an inserted wrong discharge lamp and a discharge lamp conforming in rated power to the lighting device and prevents deterioration of an operational life of the lamp caused by the lamp power difference from the lighting device and avoids a danger of lamp damage caused by its erroneous use to thereby improve a safety.

In accordance with an aspect of the present invention, there is provided a discharge lamp lighting device which comprises a first DC power source, a second DC power source (such as a voltage step-down chopper circuit) for generating a voltage necessary for a discharge lamp from the first DC power source, a feedback control circuit for calculating a power necessary for the discharge lamp to perform feedback control over the DC power sources, a polarity switching circuit for switching polarities of an output of the DC power source to apply the output to the discharge lamp in the form of a low frequency rectangular wave, an ignitor for superimposing a high pulse voltage to the discharge lamp at the time of starting the lamp, and a capacitor forming a closed circuit together with the ignitor, and wherein there is provided a control circuit for operating the polarity switching circuit at a low frequency and chopper-operating it at a high frequency to suppress an excessive charging/discharging current flowing through the capacitor when the polarities of the polarity switching circuit are switched. In the present invention, the polarity switching circuit comprises, for example, a bridge circuit including switching elements.

With such an arrangement of the invention as explained above, only during flowing of the excessive current through the capacitor, the polarity switching circuit is operated at the normal low frequency and chopper-operated at the high frequency, so that the excessive current based on the charging/discharging operation flowing from the capacitor to the switching elements can be suppressed, thereby reducing stress of the switching elements and achieving stable operation of the discharge lamp lighting device.

BRIEF DESCRIPTION OF THE DRAWINGS

Other objects and advantages of the present invention will become apparent from the following detailed description of preferred embodiments thereof in connection with the accompanying drawings, in which.

Figure 1:
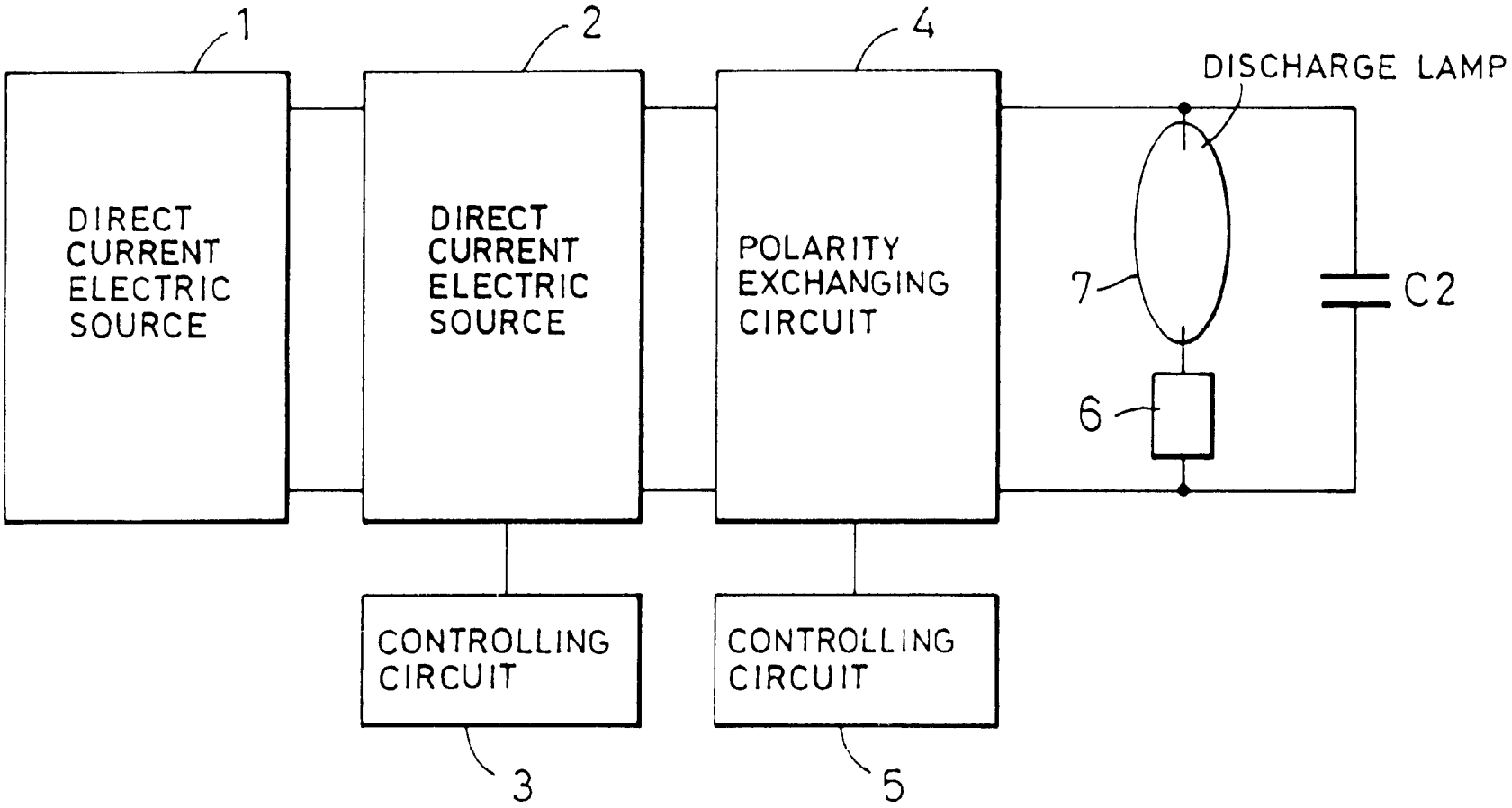
FIG. 1 is a block diagram showing a basic arrangement of a discharge lamp lighting device in accordance with the present invention.

While the present invention will now be described with reference to the embodiments shown in the drawings, it should be appreciated that the intention is not to limit the present invention only to these embodiments shown but to include all alterations, modifications and equivalent arrangements possible within the scope of appended claims.

DETAILED DESCRIPTION OF THE PREFERRED EMBODIMENTS

FIG. 1 shows a block diagram of a basic arrangement of a discharge lamp lighting device in accordance with the present invention, which includes a first DC power source 1, a discharge lamp 7, a second DC power source 2 for generating a voltage and current necessary for the discharge lamp 7 from the first DC power source 1, a control circuit 3 for performing feedback control over the second DC power source 2, a polarity switching circuit 4 for converting an output of the second DC power source 2 to a rectangular-wave AC power and supplying the AC power to the discharge lamp 7, a control circuit 5 for controlling the polarity switching circuit 4, an ignitor 6 for supplying a high voltage pulse to the discharge lamp 7 as superimposed thereon, and a capacitor C2 connected in parallel to a series circuit of the discharge lamp 7 and ignitor 6.

Figure 2:
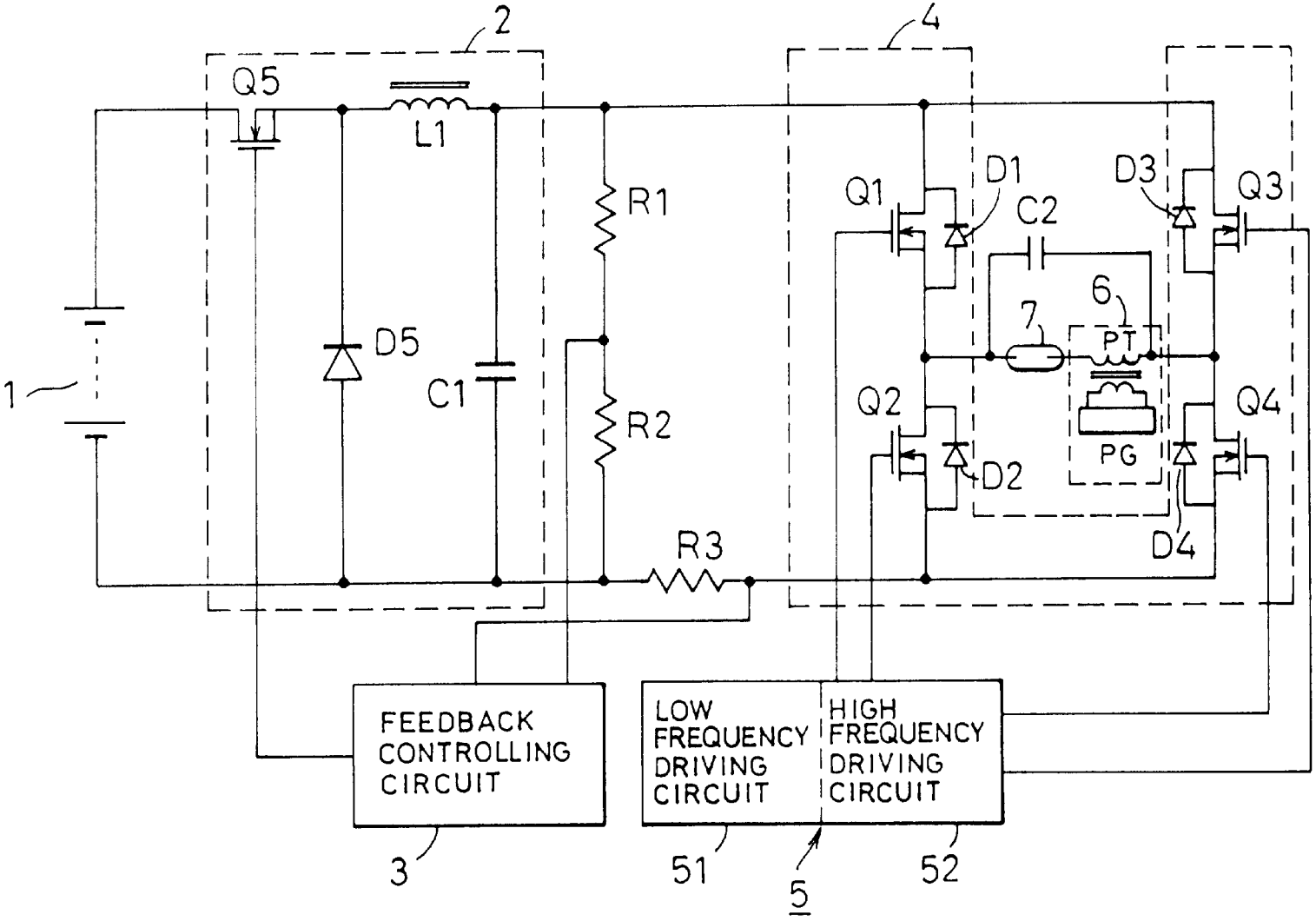
FIG. 2 is a circuit diagram of a first embodiment of the present invention.

A detailed circuit configuration of the lighting device of FIG. 1 is shown in FIG. 2. In the illustrated example, the second DC power source 2, which comprises a voltage step-down chopper circuit made up of a switching element Q5, an inductor L1 and a diode D5, is provided so that, when the switching element Q5 is turned ON and OFF at a high frequency, control of its ON duration or switching frequency causes appearance of a required voltage across a capacitor C1. An output voltage of the voltage step-down chopper circuit is detected by lamp voltage detecting resistors R1 and R2 and an output current of the voltage step-down chopper circuit is detected by a lamp current detecting resistor R3, so that the feedback control circuit 3 controls the ON duration or switching frequency of the switching element Q5. The polarity switching circuit 4 comprises a full bridge circuit, which is made up of 4 switching elements Q1, Q2, Q3 and Q4 and 4 parasitic diodes D1, D2, D3 and D4 connected in reverse bias direction parallel with the switching elements Q1, Q2, Q3 and Q4, is driven by a low frequency driving circuit 51 so that diagonally coupled switching element pairs Q1, Q4 or Q2, Q3 are turned ON and OFF alternately to cause reversing operation of polarities of a voltage applied to the discharge lamp 7. Further, for the purpose of preventing an excessive current from flowing through the capacitor C2, upon switching of the polarities when the lamp is unlit, the polarity switching circuit 4 is chopper-operated by the high frequency driving circuit 52 at the high frequency and also be operated at a normal low frequency.

Figure 3:
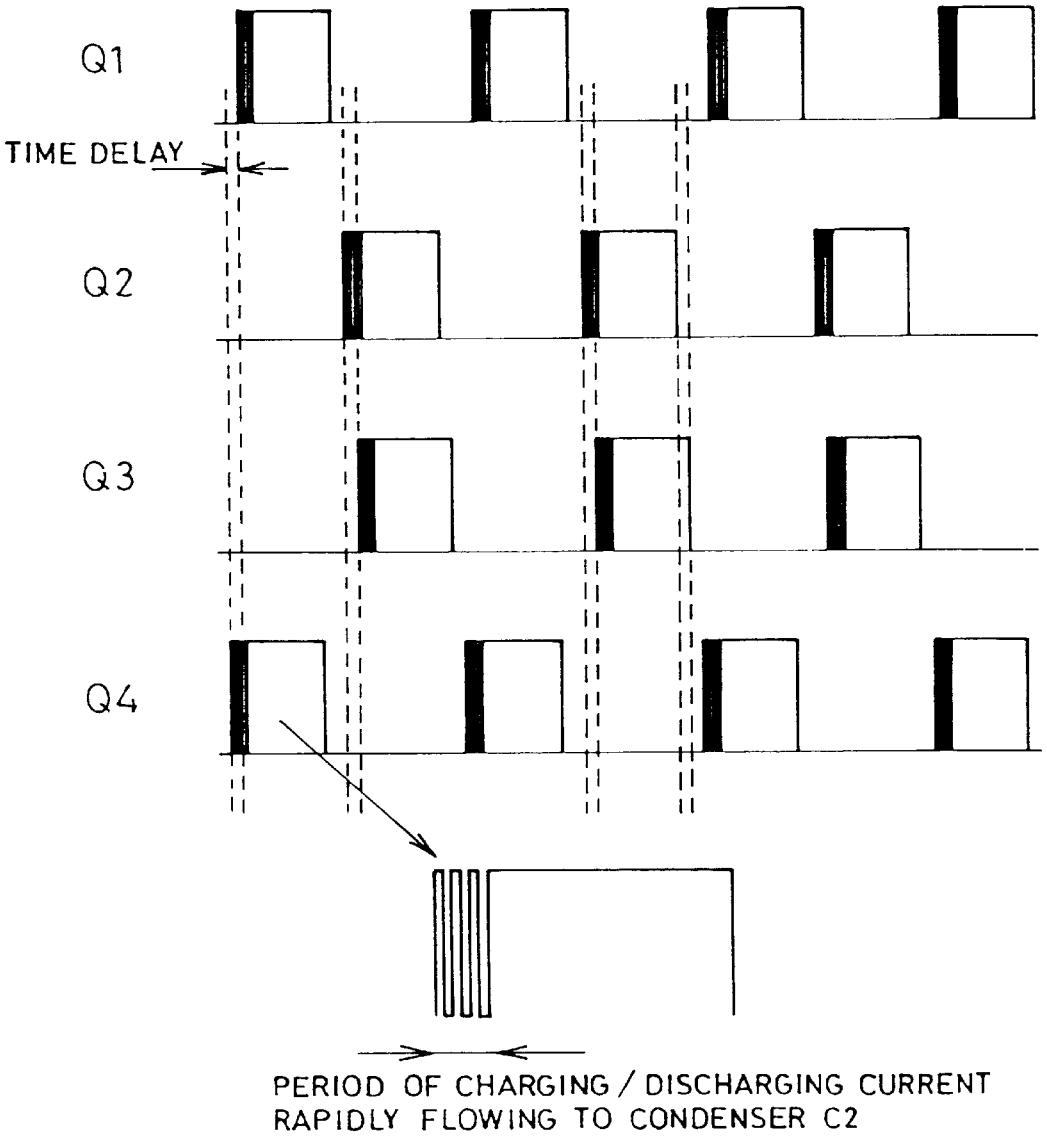
FIG. 3 shows waveforms of operational signals appearing in the first embodiment of FIG. 2.

In FIG. 2, when it is desired to light the discharge lamp 7, the second DC power source 2 boosts to a voltage necessary for the discharge lamp 7 to generate a prescribed voltage (such as about 300V), and then applies the prescribed voltage to the discharge lamp 7 through the polarity switching circuit 4 and ignitor 6. In the polarity switching circuit 4, in this case, the switching element pair Q1 and Q4 or Q2 and Q3 are turned ON to apply a start voltage to the discharge lamp 7, at which time the discharge lamp 7 has an impedance Z1*a* of infinity. The switching of the polarity switching circuit 4 is carried out, in the illustrated example, at such timing as shown in FIG. 3. As shown in FIG. 3 for example, the switching element Q2 (or Q4) is turned ON and then the switching element Q3 (or Q1) is turned ON. When the switching element Q2 (or Q4) is turned ON, charge so far stored in the capacitor C2 forming a closed circuit together with the ignitor 6 is quickly discharged through the switching element Q2 (or Q4) and the parasitic diode D4 (or D2) of the other switching element Q4 (or Q2) provided at a low potential side. Further, after the charge of the capacitor C2 is fully discharged as mentioned above, the switching element Q1 (or Q3) is turned ON. At this time, a charging current quickly flows from the capacitor C1 provided at an output side of the second DC power source 2 to the capacitor C2 via the then-paired switching elements. In order to moderate the charging current, in accordance with the present invention, the polarity switching circuit 4 is chopper-operated by the high frequency driving circuit 52 at the high frequency and also is operated at the normal low frequency.

If the switching element Q5 of the second DC power source 2 is put in its ON state during the charging period of the capacitor C2, then the charging current quickly flows from the first DC power source 1 into the capacitor C2. This results in that, during the polarity switching operation of the polarity switching circuit 4, the charging and discharging operations of the capacitor C2 cause the stress of the switching elements Q1 to Q4 and Q5 to be increased. To prevent the stress, in accordance with the invention as set forth in claim 4, the switching element Q5 is turned OFF of the second DC power source 2 during this period.

Embodiments of the present invention will be detailed in connection with the attached drawings. Referring first to FIG. 2, there is shown a first embodiment of the present invention, which includes the control circuit 5 for causing polarity switching circuit 4 to be chopper-operated at the high frequency and be operated at the normal low frequency only while an excessive current flows from the capacitor C2 into the polarity switching circuit 4, thereby limiting the current flowing through the capacitor C2. In particular, the flowing period of the excessive current through the capacitor C2 is while the lamp is unlit, in which (i.e., an output voltage of the second DC power source 2) becomes high. The switching operation of the switching elements Q1, Q2, Q3 and Q4 of the polarity switching circuit 4 is carried out at such timing as shown in FIG. 3. It will be seen from FIG. 3 that, of the switching elements Q1, Q2, Q3 and Q4 of the polarity switching circuit 4, the switching elements Q1 and Q3 connected to the higher potential side when receiving a signal from the switching elements Q2 and Q4 connected to the lower potential side are turned ON, so that there necessarily exists such a period that only the switching element Q2 or Q4 connected to the lower potential side is turned ON. At this time, the charge accumulated in the capacitor C2 is discharged through a path of the capacitor C2, switching element Q2 (or Q4) and diode D4 (or D2). This discharging current causes the switching element connected to the lower potential side to be turned ON, so that the switching element connected to the lower potential side is chopper-operated by the high frequency driving circuit 52 of the control circuit 5 at the high frequency during such a period that the charge accumulated in the capacitor C2 is quickly discharged. After the switching element connected to the lower potential side is turned ON, if the switching element Q1 or Q3 connected to the higher potential side is turned ON, a charging current quickly flows into the capacitor C2 which became null in its accumulated charge via a path of the capacitor C1 provided in the output stage of the second DC power source 2, the switching element Q1 (Q3), the capacitor C2 and the switching element Q4 (Q2). In this case, the switching element connected to the higher potential side is chopper-operated at the high frequency and is operated at the low frequency only for a certain time. At this time, drive signals for the respective switching elements Q1, Q2, Q3 and Q4 of the polarity switching circuit 4 are switched at the high frequency only during the rapid charging and discharging operations of the capacitor C2, and are switched at the low frequency, as shown in FIG. 3. As a result, the excessive current flowing during the charging/discharging operations of the capacitor C2 can be reduced and thus the stress of the switching elements can be lightened.

Figure 4:
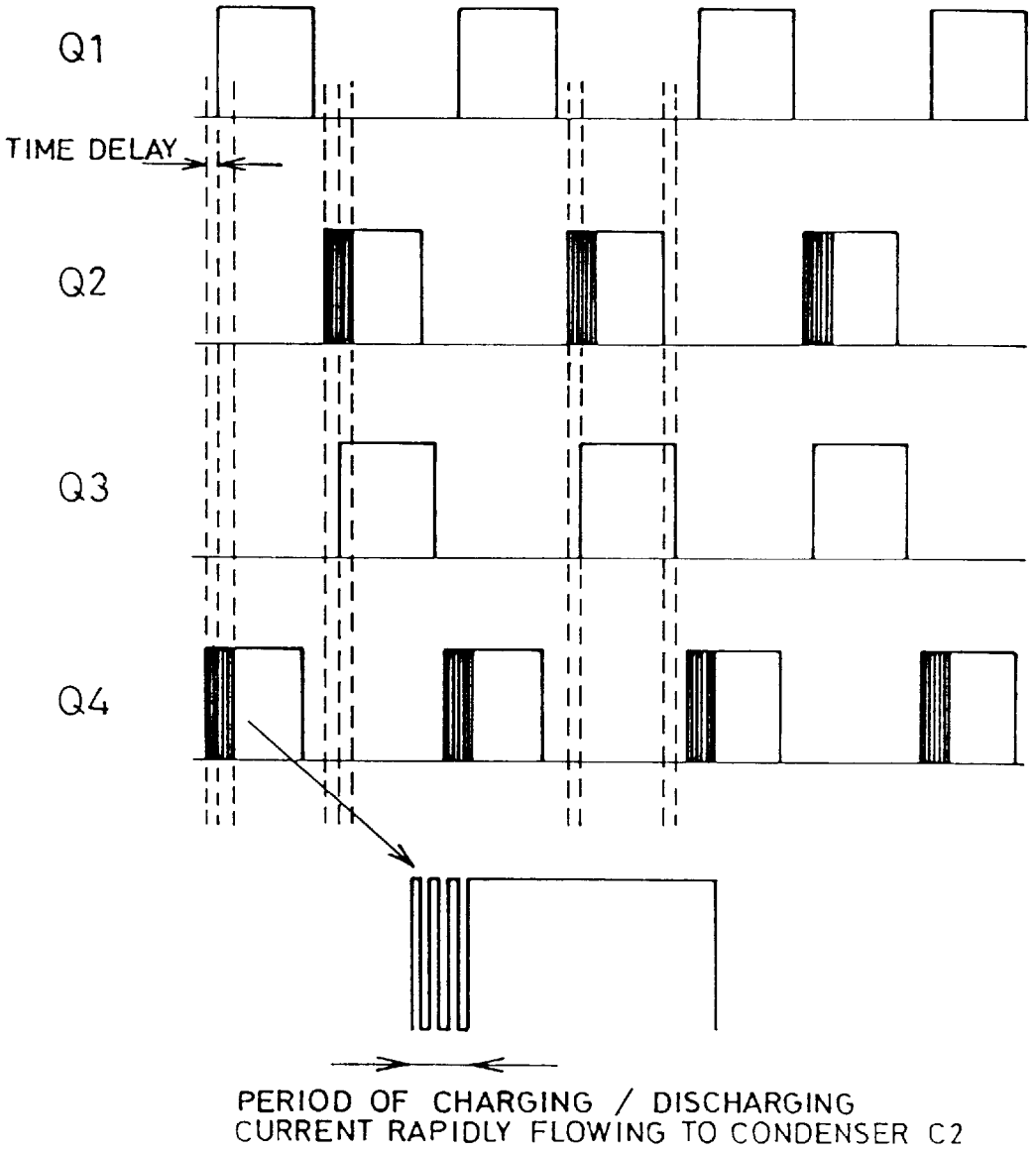
FIG. 4 shows waveforms of operational signals appearing in a second embodiment.

Shown in FIG. 4 is a second embodiment of the present invention. After the switching element Q2 (or Q4) connected to the lower potential side is turned ON and the charge of the capacitor C2 is fully discharged as mentioned above, the switching element Q3 (or Q1) connected to the higher potential side is turned ON. At this time, a charging current flows into the capacitor C2 from the capacitor C1 in the output stage of the second DC power source 2. Due to the fact that the charging current is excessive, the switching elements Q1 and Q3 have been chopper-operated at the high frequency and at the low frequency in the aforementioned explanation. In the present embodiment, however, the switching element Q1 or Q3 connected to the higher potential side are operated at the normal low frequency, while the switching elements Q2 and Q4 connected to the lower potential side are chopper-operated at the high frequency even during flowing of the charging current through the capacitor C2. With respect to the then drive signals for the switching elements Q1, Q2, Q3 and Q4 of the polarity switching circuit 4, only the switching element Q2 or Q4 connected to the lower potential side is operated at the low frequency and also chopper-operated at the high frequency. (Although the above explanation has been made in this example in connection with the case where there is a time difference between turning ON and OFF of the switching elements, the above holds true even when there is no time difference and the polarities of the opposing switching elements are switched simultaneously.)

Figure 5:
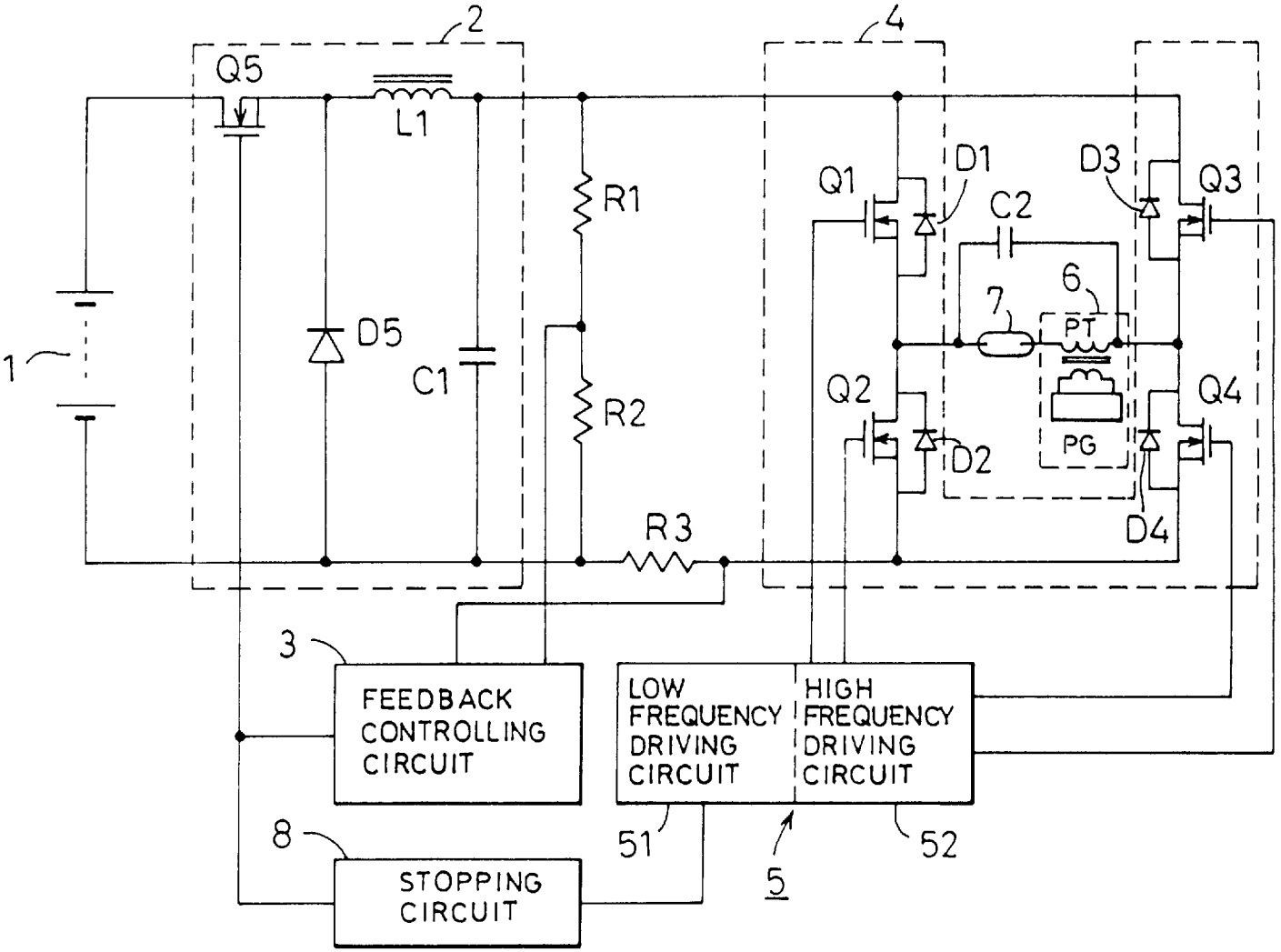
FIG. 5 is a circuit diagram of a third embodiment of the present invention.
Figure 6:
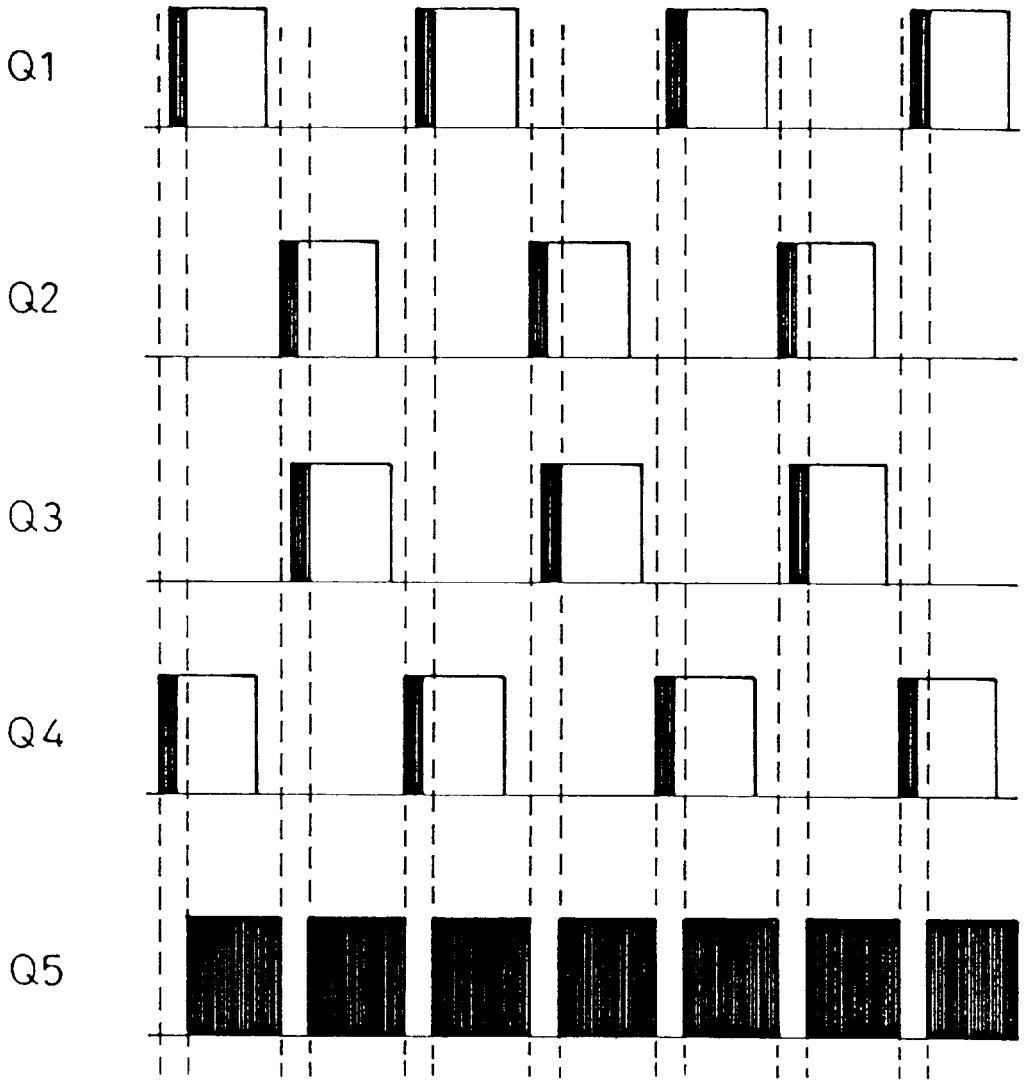
FIG. 6 shows waveforms of operational signals appearing in the third embodiment of the present invention of FIG. 5.

FIG. 5 shows a third embodiment of the present invention. As mentioned above, when the switching element Q4 or Q2 connected to the lower potential side is turned ON and then the switching element Q1 or Q3 connected to the higher potential side is turned ON, a charging current rapidly flows into the capacitor C2 which became null in charge through a path of the capacitor C1 of the output stage of the second DC power source 2, the switching element Q1 (or Q3), the capacitor C2 and the switching element Q4 (or Q2). During this charging period, an ON state of the switching element Q5 of the second DC power source 2 causes an abrupt charging current to flow from the first DC power source 1 through the switching element Q5 into the capacitor C2. When the switching element Q5 of the second DC power source 2 is stopped by a DC power stopping circuit 8 only during the flowing of the rapid charging and discharging currents through the capacitor C2 as shown in FIG. 6, during which the capacitor C2 is charged by the second DC power source 2, thus lightening the rapid discharging current flowing from the first DC power source 1 into the capacitor C2. As a result, the stress of the switching element Q5 of the second DC power source 2 as well as the stress of the switching elements Q1 to Q4 of the polarity switching circuit 4 can be reduced. In this conjunction, the drive signals for the switching elements Q1 to Q4 may be the drive signals of FIG. 4 explained in connection with the second embodiment.

There are various types of discharge lamps at present, some of which belonging to an identical type are the same with regard to base or shape in spite of different lamp powers. For this reason, it is difficult to know a desired rated lamp power at first glance. When a lamp conforming to a ballast is not used for such a reason, it inconveniently involves deterioration of the operational life of the lamp. An improvement on this is shown as a fourth embodiment which follows.

Figure 7:
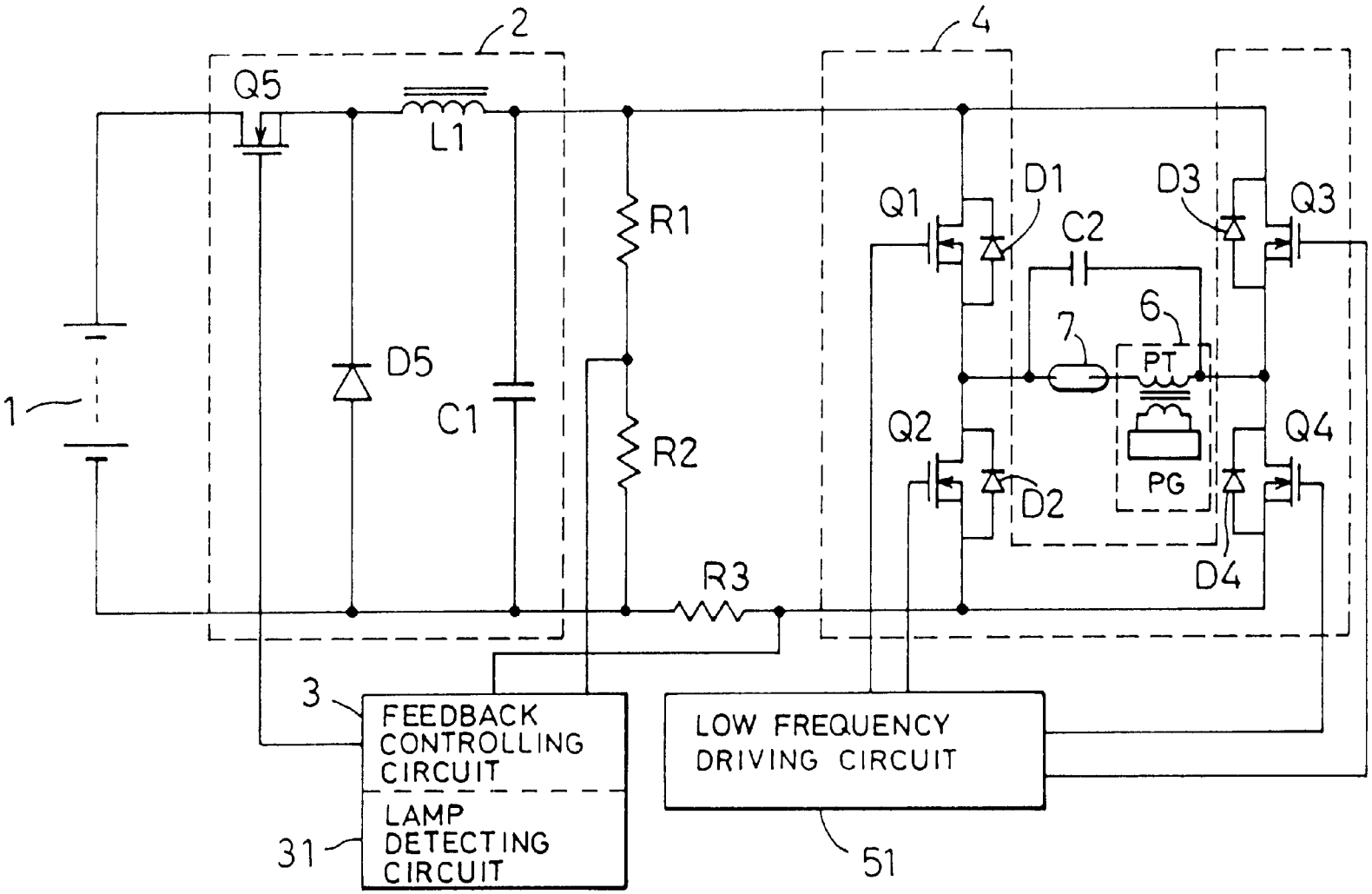
FIG. 7 is a circuit diagram of a fourth embodiment of the present invention.
Figure 8:
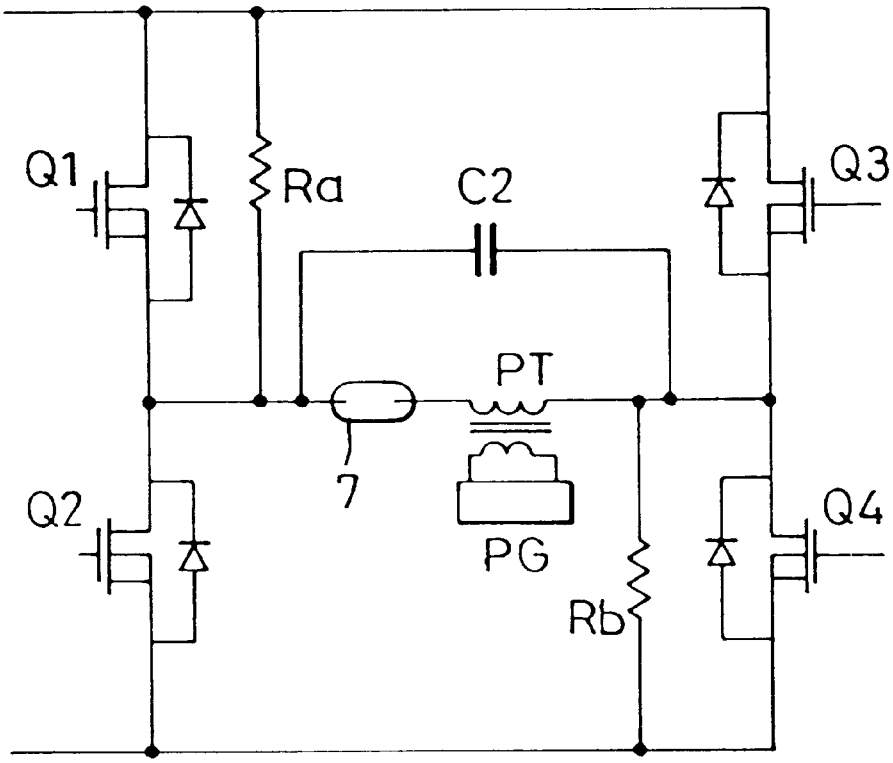
FIG. 8 is a circuit diagram of an arrangement of a major part of the fourth embodiment.
Figure 9:
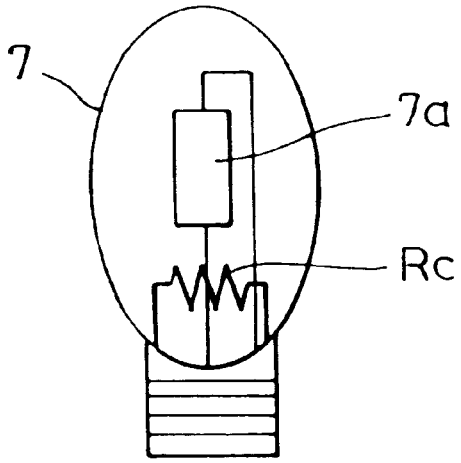
FIG. 9 shows a schematic structure of a discharge lamp in the fourth embodiment.

The fourth embodiment of the present invention is shown in FIG. 7. In the present embodiment, a lamp detecting circuit 31 is added which includes, as shown in FIG. 8 for example, resistors Ra and Rb having sufficiently high resistances and connected across the switching elements Q1 and Q4 which form one pair in the polarity switching circuit 4 respectively, and also includes a resistor Rc provided within the discharge lamp 7 as lighting and lamp power detecting means as shown in FIG. 9. With such an arrangement, in a lamp switch off mode, a current flows through a path of the high resistance Ra, the resistance Rc within the discharge lamp 7 and the high resistance Rb. This current is converted to a voltage value through the lamp current detecting resistor R3, and the lamp detecting circuit 31 detects a lamp state (lit state or extinguished state) of the discharge lamp 7 on the basis of the voltage value to control the second DC power source 2. When the resistor within the discharge lamp is set to have different resistance values depending on the magnitude of its rated lamp power, the rated lamp power can be detected by the lamp detecting circuit 31 on the basis of the value of the current flowing through the detection resistor R3. Thus, when the lamp used as a load conforms to the discharge lamp lighting device, the discharge lamp lighting device normally operates; whereas, when the lamp does not conform to the discharge lamp lighting device, the discharge lamp lighting device stops, for example, stops the switching operation of the second DC power source 2 to disconnect power supply to the load. This enables avoidance of deterioration of lamp life or prevention of lamp damage.

Reference has been made to only part of the discharge lamp lighting device without referring to an overall detailed circuit diagram in the foregoing first to fourth embodiments. Here are examples when these embodiments are applied to actual discharge lamp lighting devices.

Figure 10:
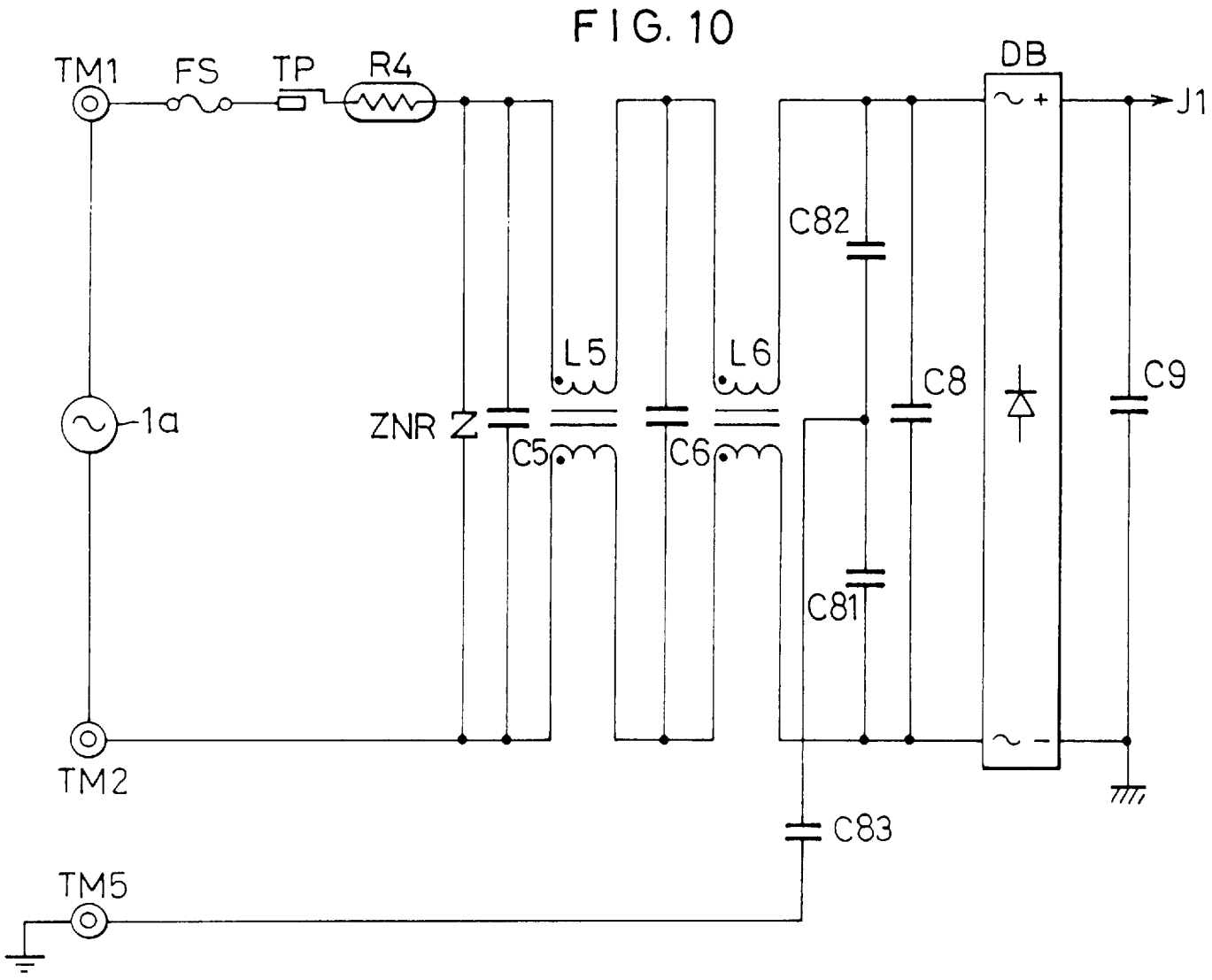
FIG. 10 is a circuit diagram of a power input section of a lighting device of the present invention implemented in the form of a product.
Figure 11:
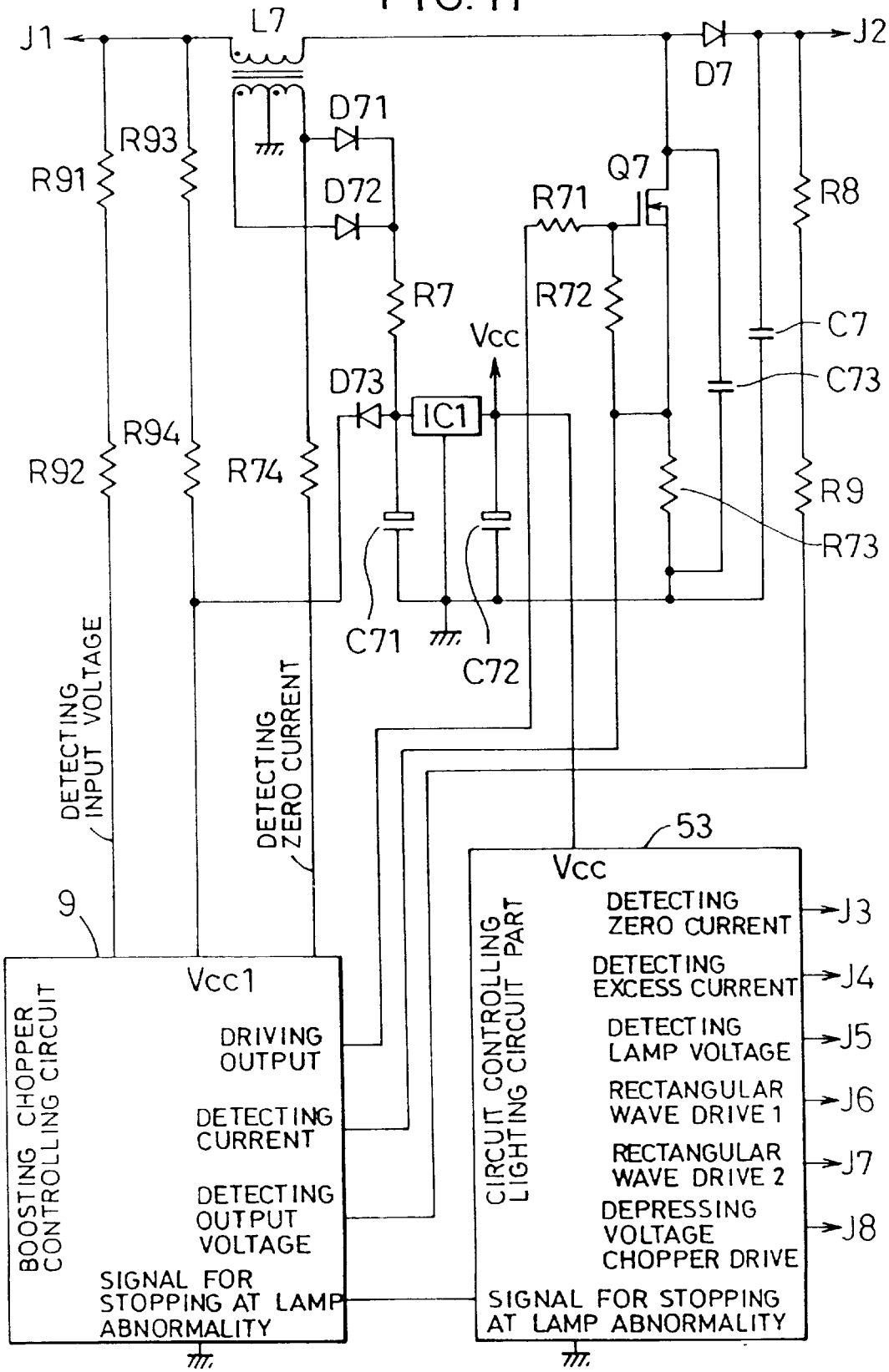
FIG. 11 is a circuit diagram of a power factor improvement section in the lighting device of the present invention implemented as a product.
Figure 12:
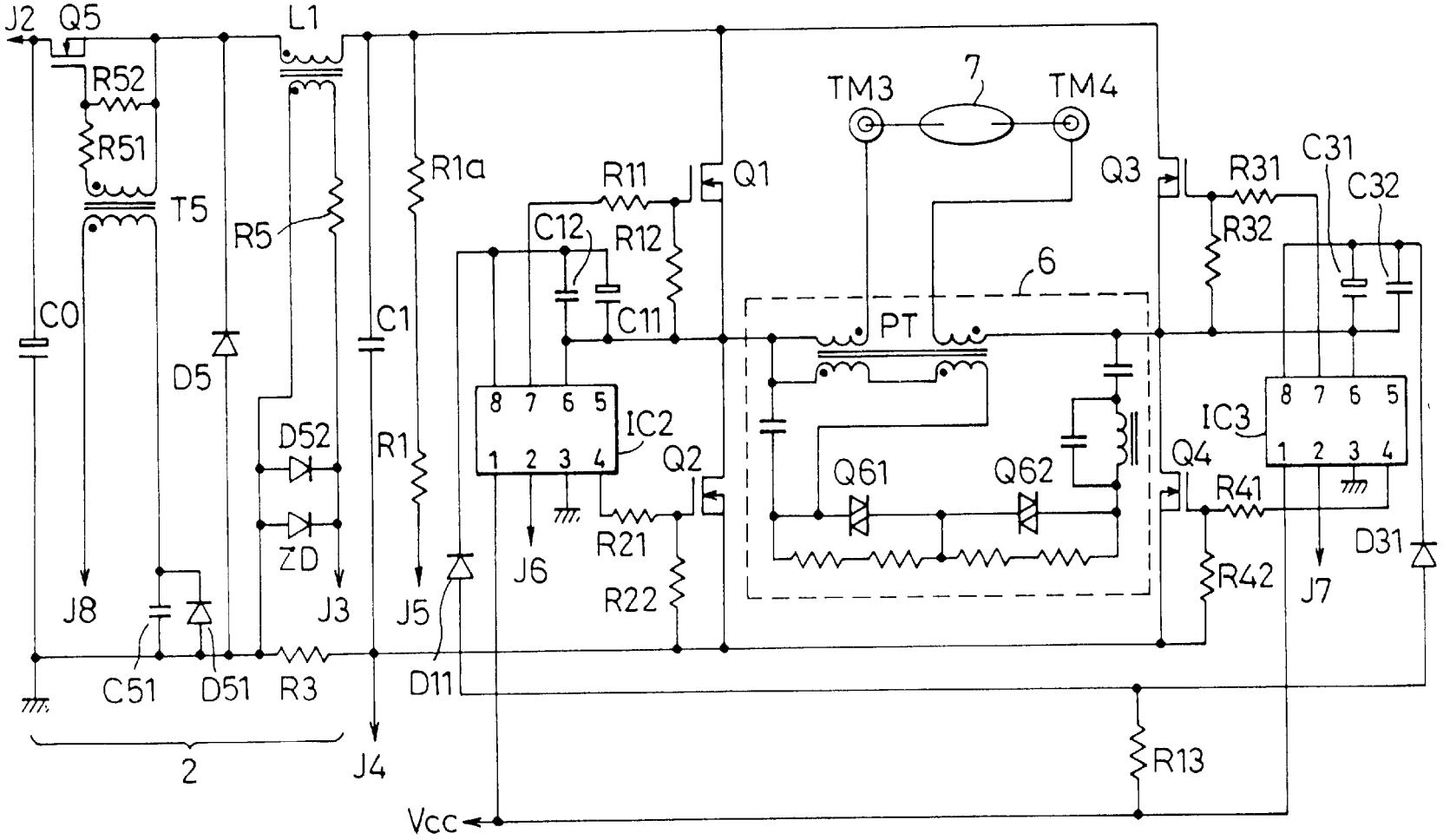
FIG. 12 is a circuit diagram of a lighting circuit section in the lighting device of the present invention implemented in the form of a product.

FIGS. 10 to 12 show an example of a lighting device which incorporates the present invention in the form of a product actually implemented. More specifically, FIG. 10 shows a power supply input section, FIG. 11 shows a power factor improvement section, FIG. 12 shows a lighting circuit section, in which drawings reference symbols J1 to J18 denotes junction points for interconnection of therebetween.

In the power supply input section of FIG. 10, an AC power source 1*a* connected to terminals TM1 and TM2 is connected to AC input terminals of a rectifier circuit DB through a fuse FS, a thermal protector TP, low resistance R4 and a filter circuit. The rectifier circuit DB is also connected at its DC output terminals with a capacitor C9 therebetween. The capacitor C9 has a small capacitance and actual smoothing operation is carried out by a voltage step-up chopper circuit in the power factor improvement section of a latter stage. The filter circuit includes a surge absorber ZNR (made of zinc oxide having a nonlinear resistance characteristic), coils L5 and L6, capacitors C5, C6, C8, C81 and C82. A midpoint between a series circuit of the capacitors C81 and C82 is connected via a capacitor C83 to a terminal TM5, which in turn is grounded.

The power factor improvement section of FIG. 11 comprises a voltage step-up or boosting chopper circuit which includes an inductor L7, a switching element Q7 and a diode D7. The voltage step-up chopper circuit receives a full-wave rectified output of the rectifier circuit DB from the point J1 and supplies a boosted smooth DC voltage to an electrolytic capacitor C0 (refer to FIG. 12) connected to the point J2. The switching element Q7 in the voltage step-up chopper circuit is driven by a drive output of a boosting chopper control circuit 9 through resistors R71 and R72, which current is detected by a resistor R73. A current flowing through the inductor L7 is detected through a resistor R74 connected to a secondary winding. Further, an output voltage appearing at the point J2 is detected through resistors R8 and R9, and an input voltage appearing at the point J1 is detected through resistors R91 and R92. An operational power Vcc1 of the boosting chopper control circuit 9 is supplied, a power ON mode, from the point J1 through resistors R93 and R94; whereas, when the switching operation of the switching element Q7 starts, a secondary winding output of the inductor L7 is rectified by diodes D71 and D72 and a DC voltage obtained through the resistor R7 and capacitor C71 is supplied through a diode D73. The DC voltage appearing across the capacitor C71 is converted to a constant voltage by a voltage regulator IC1 of a 3-terminal type, and the constant voltage is used as an operational power Vcc of a lighting circuit section control to circuit 53. The lighting circuit section control circuit 53 detects a zero current, an excessive current and a lamp voltage through the points J3 to J5 connected to the lighting circuit section shown in FIG. 12, and outputs rectangular wave drive signals and a voltage step-down chopper drive signal through the points J6 to J8.

The lighting circuit section of FIG. 12, which has the voltage step-down chopper circuit 2, functions to reduce the DC voltage at the point J2 obtained through the electrolytic capacitor C0 down to an arbitrary DC voltage level via the switching element Q5, diode D5 and inductor L1, whereby the lamp voltage appears across the capacitor C1. The lamp voltage appearing across the capacitor C1 is detected through resistors R1*a* and R1 and point J5. Further, a current flowing through the inductor L1 is detected through a resistor R5 and point J3, while a current flowing through the voltage step-down chopper circuit 2 is detected through one end of the resistor R3 the point J4. The switching element Q5 of the voltage step-down chopper circuit 2 is driven by the drive signal supplied to the point J8 via a transformer T5 and resistors R51 and R52.

A polarity inverting circuit comprises a full bridge circuit made up of 4 switching elements Q1 to Q4, which in turn are driven by general drive circuits IC2 and IC3 through resistors R11, R12; R21, R22; R31, R32; R41, R42. The rectangular wave drive signals are supplied from the points J6 and J7. The drive circuits IC2 and IC3 are supplied with the aforementioned constant voltage Vcc as their operational power. Capacitors C11, C12; C31, C32 for driving the switching elements Q1 and Q3 connected to the higher potential side are charged with the constant voltage Vcc through a resistor R13 and diodes D11 and D31. The full bridge circuit is connected at its output side with the discharge lamp 7 through a pulse transformer PT of the ignitor circuit 6. Terminals TM3 and TM4 are for connection of the discharge lamp 7. The lamp 7 is, for example, M98 (70W) or M130 (35W) based on specifications of the American National Standards Institute (ANSI) standards and its light emitting tube is of a ceramic type. Pulse generation of the ignitor circuit 6 is stopped after the discharge lamp 7 starts its discharging operation.

In accordance with the present invention, in a rising part of the rectangular wave drive signal supplied via the points J6 and J7 to a No. 2 pin of each of the drive circuits IC2 and IC3, there is provided a period for the high frequency chopper operation to moderate excessive charging and discharging currents. During this period, the switching operation of the switching element Q5 is stopped to prevent any excessive current. Though the capacitor C2 is not illustrated in FIG. 12, the turn number of the secondary winding of the pulse transformer PT is large and there exists a stray capacitance, which capacitance acts as the capacitor C2. It goes without saying that, as shown in FIG. 2, the capacitor C2 may be connected as a separate part.

Figure 13:
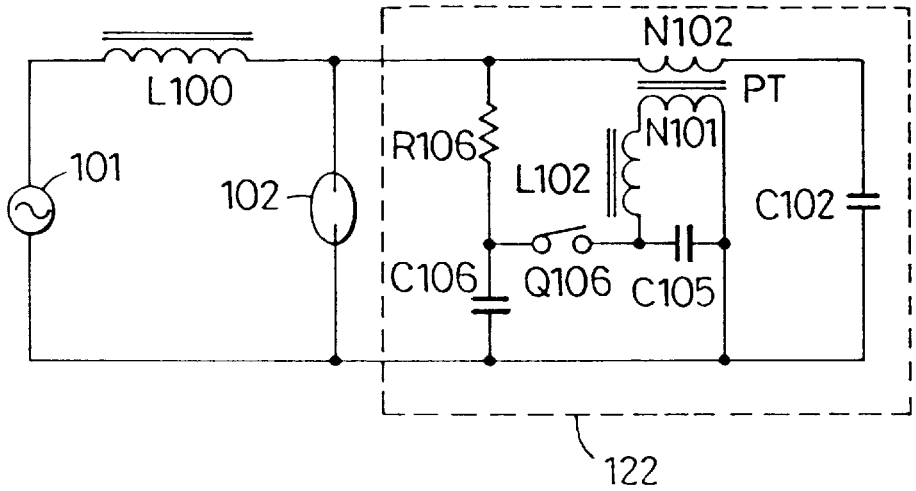
FIG. 13 is a circuit diagram of a fifth embodiment of the present invention.

FIG. 13 shows a fifth embodiment in which an inductor L102 is inserted in series with a low-voltage side winding N101 of the pulse transformer PT so as to suppress a high-frequency oscillation current I101 flowing through the low-voltage side winding N101 during the discharging operation of a discharge lamp 102.

In the present embodiment, since the inductor L102 is inserted as shown in FIG. 13, even when the discharge lamp 102 starts its discharging operation and this causes reduction of the inductance value of the low-voltage side winding N101 of the pulse transformer PT, the provision of the inductor L102 enables suppression of a current flowing from capacitors C106 and C105 and thus enables reduction of a peak value Ip102 of the oscillation current I101. Further, with respect to even a oscillation frequency contained in the high pulse voltage, since the inductor L102 is provided in a closed circuit of the capacitors C106 and C105 and low-voltage side winding N101 which define the oscillation frequency, the oscillation frequency can be set to be low and the starting operation of the discharge lamp 102 can be reliably carried out.

Figure 14:
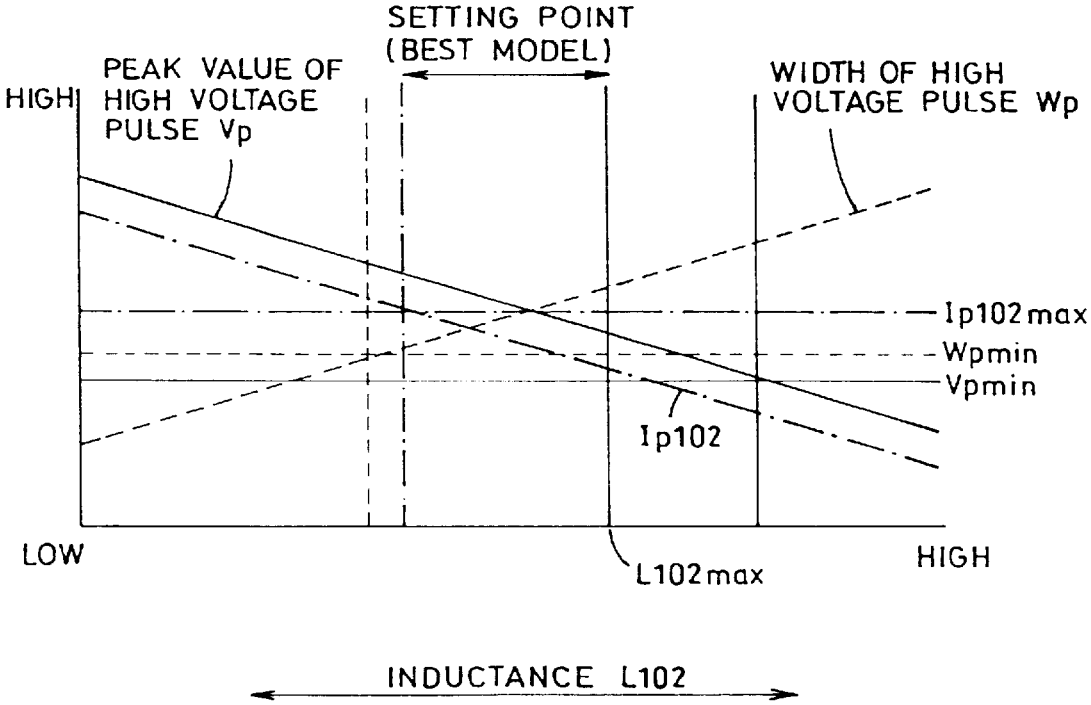
FIG. 14 is a diagram for explaining a sixth embodiment of the present invention.
Figure 16:
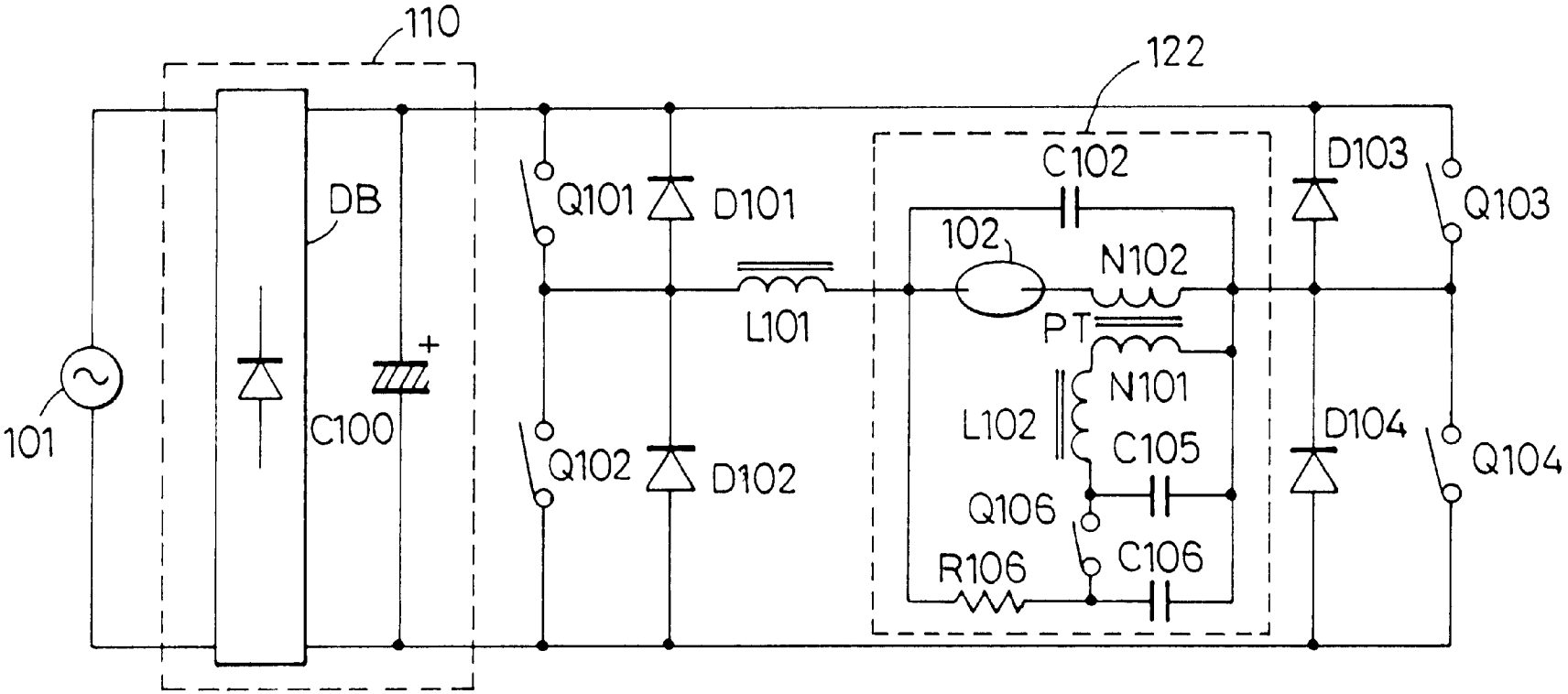
FIG. 16 is a circuit diagram of an eighth embodiment of the present invention.

Shown in FIG. 16 is a sixth embodiment in which the value of the inductor L102 inserted in the fifth embodiment is prescribed. In FIG. 14, abscissa denotes the value of the inductor L102, and ordinate denotes the peak value Vp and pulse width Wp of the high pulse voltage and the peak value Ip102 of the oscillation current I101. As will be seen from FIG. 14, as the value of the inductor L102 is increased, the oscillation frequency of the high pulse voltage becomes low, so that the pulse width Wp becomes large and the peak value Ip102 of the oscillation current I101 becomes small. However, since a voltage to be developed in the low-voltage side winding N101 by the oscillation current I101 flowing through the low-voltage side is taken up by the inductor L102 to thereby reduce the peak value Vp of the high pulse voltage. On the contrary, as the value of the inductor L102 is decreased, the peak value Vp of the high pulse voltage can be kept high but the oscillation frequency becomes high, which results in that the pulse width Wp becomes narrow and the peak value Ip102 of the oscillation current I101 becomes large.

Assume now that the peak value of the high pulse voltage necessary for starting the discharge lamp 102 is denoted by Vpmin, the pulse width of the high pulse voltage is by Wpmin, the maximum allowable current value of the capacitor C105 is by Ip102max, and the maximum value of the inductor L102 in a bobbin size structurally realizable is by L102max. Then the optimum design points are as shown in the drawing. In this connection, since maximum allowable ranges of the peak value and pulse width of the target high pulse voltage and a maximum allowable range of the peak value Ip102 of the oscillation current vary largely from ballast to ballast, the specific numeric value of the inductor L102 is not specifically given herein.

Figure 15:
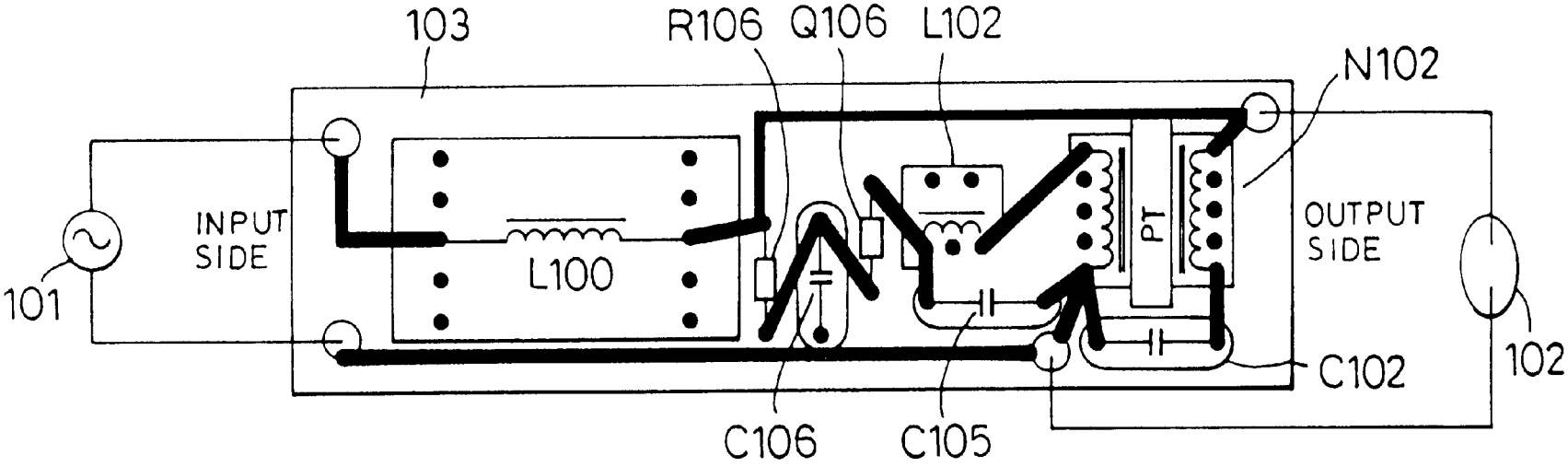
FIG. 15 is a plan view of a seventh embodiment of the present invention in its mounted state.

FIG. 15 is a seventh embodiment, showing a state of a printed circuit board 3 on which the circuit of the aforementioned first or second embodiment is mounted. A point to be most noted at the time of mounting such a circuit on the printed circuit board is a path through which the oscillation current I101 flows. That is, since the high-frequency oscillation current I101 has a high possibility of generating noise, such a circuit should be mounted as separated from the other electronic parts or patterns. In the present embodiment, the other electronic parts and patterns are arranged so as not to be present in a closed circuit of the capacitor C106, switching element Q106, inductor L102, capacitor C105 and the low-voltage side winding N101 of the pulse transformer PT, through which closed circuit the high-frequency oscillation current I101 flows. With such an arrangement, the circuit can be prevented from operating erroneously due to the high-frequency oscillation current and there can be provided a discharge lamp lighting device which is reliably able to start the discharge lamp.

Although explanation has been made in connection with the case where a conventional ballast is used as the major ballast in the foregoing embodiments for the sake of convenience of explanation, it has already been found that, even when an electronic ballast is used in the discharge lamp lighting device, substantially the same effects as the above can be achieved.

FIG. 16 shows an eighth embodiment in which an electronic ballast is used as a major ballast and a lighting circuit is based on a full bridge system. The operation of this system is substantially the same as that of the prior art one and thus explanation thereof is omitted. Even the present embodiment can exhibit the same effects as in the embodiment 5 and hold a feature that the present embodiment can be made small in size, which results from the inherent merit of the electronic ballast.

Figure 17:
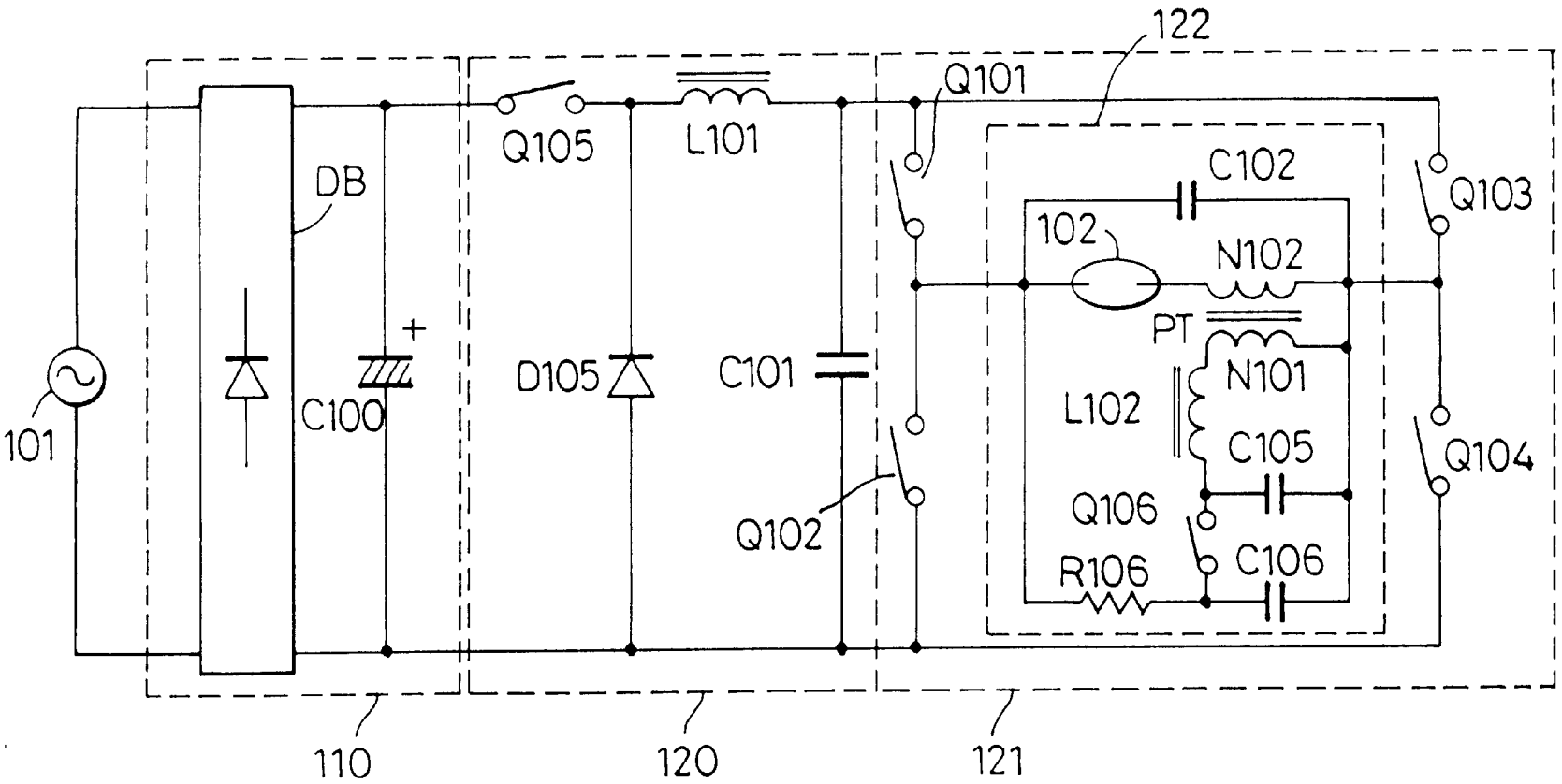
FIG. 17 is a circuit diagram of the fifth embodiment of the present invention.
Figure 18:
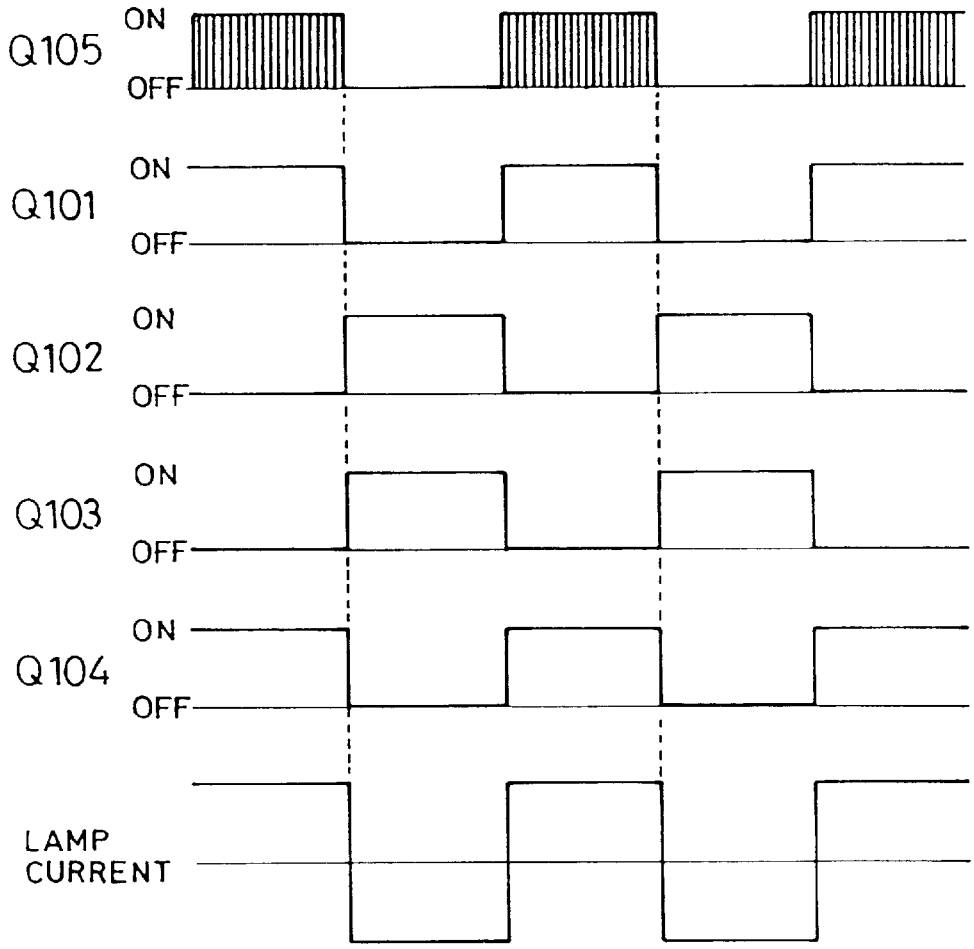
FIG. 18 shows waveforms of signals appearing in the fifth embodiment of FIG. 17.

FIG. 17 shows a ninth embodiment in which the full bridge circuit in the embodiment 8 is provided as divided into a voltage step-down chopper circuit section 120 and a polarity inverting circuit section 121. Shown in FIG. 18 are waveforms of operational currents of switching elements Q101 to Q105 as well as a waveform of a lamp current. The operation of the circuit of FIG. 17 will be briefly explained below.

The illustrated lamp lighting section includes the voltage step-down chopper circuit section 120, polarity inverting circuit section 121 and a discharge lamp start circuit 122.

The voltage step-down chopper circuit section 120, which has the switching element Q105, a diode D105, an inductor L101 and a capacitor C101, is arranged so that, when the switching element Q105 is in its ON state, a current flows from a capacitor C100 through the inductor L101 to the capacitor C101, whereas, when the switching element Q105 is in its OFF state, an energy so far accumulated in the inductor L101 is discharged into the capacitor C101 through the diode D105. By controlling the pulse width or switching frequency of the switching element Q105, the voltage of the capacitor C101, i.e., the lamp voltage can be adjusted.

The polarity inverting circuit section 121 comprises a full bridge circuit including the switching elements Q101 to Q104. In the polarity inverting circuit section 121, the switching elements Q101 to Q104 perform such operations as shown in FIG. 18 to thereby supply the illustrated rectangular wave AC power to the discharge lamp 102. With such an arrangement as mentioned above, even the present embodiment can exhibit the same effects as in the embodiment 8.

Figure 20:
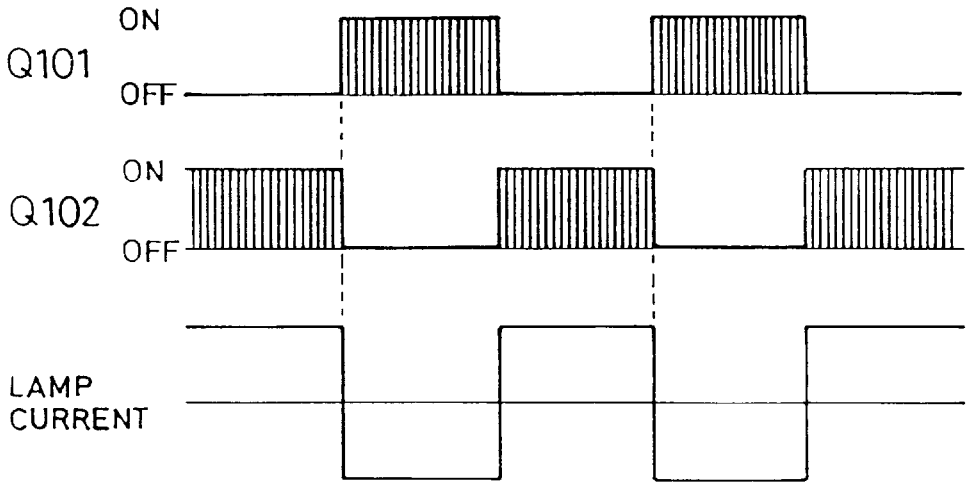
FIG. 20 shows waveforms of signals appearing in the sixth embodiment of FIG. 19.
Figure 19:
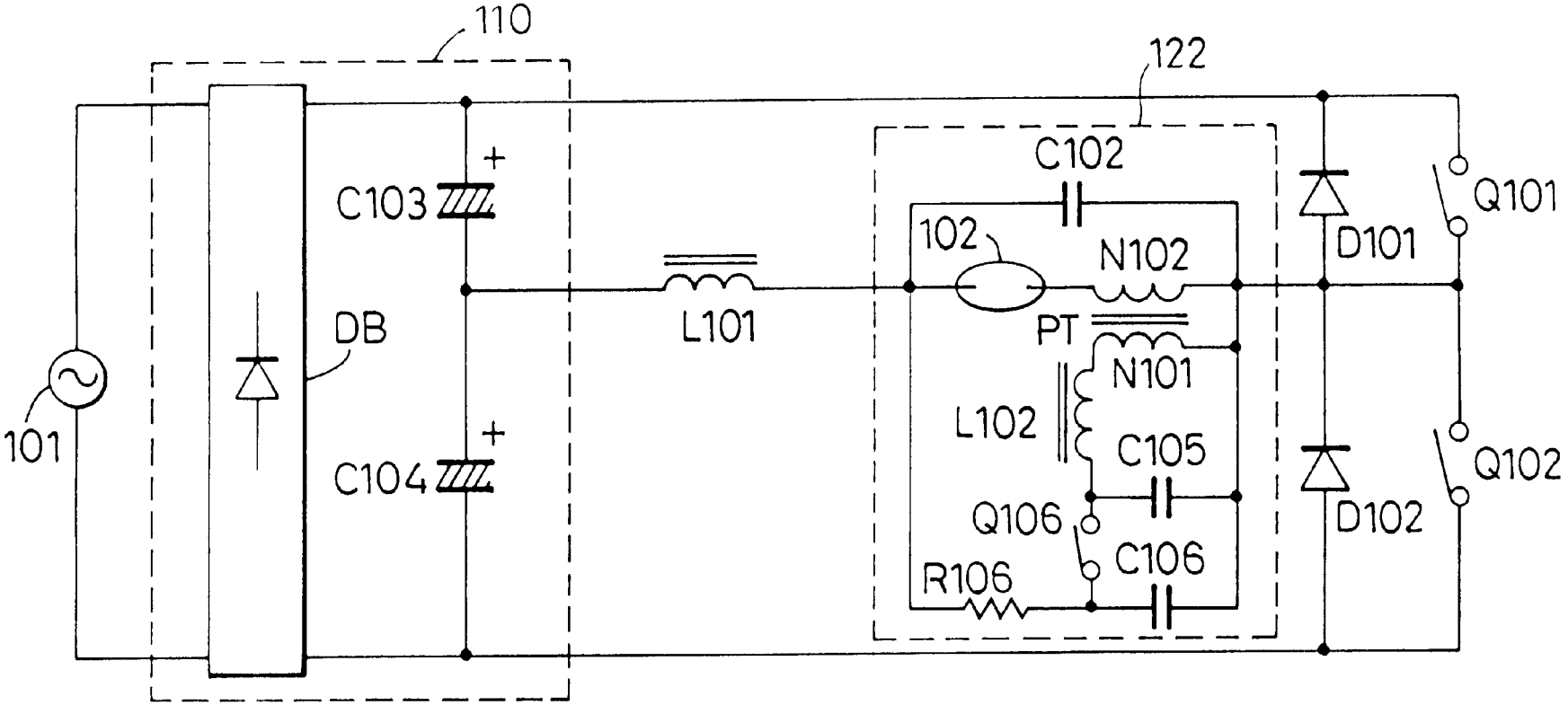
FIG. 19 is a circuit diagram of the sixth embodiment of the present invention.

There is shown in FIG. 19 a tenth embodiment in which a lamp lighting section comprises such a half bridge circuit as shown. FIG. 20 shows waveforms of ON and OFF operational currents of the switching elements Q101 and Q102 as well as a waveform of a lamp current. The operation of the circuit of FIG. 19 will be explained below. The switching elements Q101 and Q102 repeat such high frequency switching operation as shown in FIG. 20. That is, these switching elements Q101 and Q102 correspond to the switching elements Q105 and Q101 to Q104 in the circuit of FIG. 17. In a cycle during which the switching element Q101 is switching at a high frequency, the energy stored in the inductor L101 is fed back to the capacitor C104 through the diode D102 in the OFF state of the switching element Q101. Whereas, in a cycle during which the switching element Q102 is switching at a high frequency, the energy stored in the inductor L101 is fed back to the capacitor C103 through the diode D101 in the OFF state of the switching element Q102. That is, the diodes D101 and D102 perform the same function as the diode D105 in the circuit of FIG. 17.

In the present embodiment, when the switching elements Q101 and Q102 each comprise a diode-built-in type element such as FET, the diodes D101 and D102 can be replaced with the built-in diodes, whereby the total number of switching elements and diodes to be used becomes 2 and thus can be reduced when compared to 6 in the embodiment 9, which advantageously leads to cost reduction and downsizing.

Figure 21:
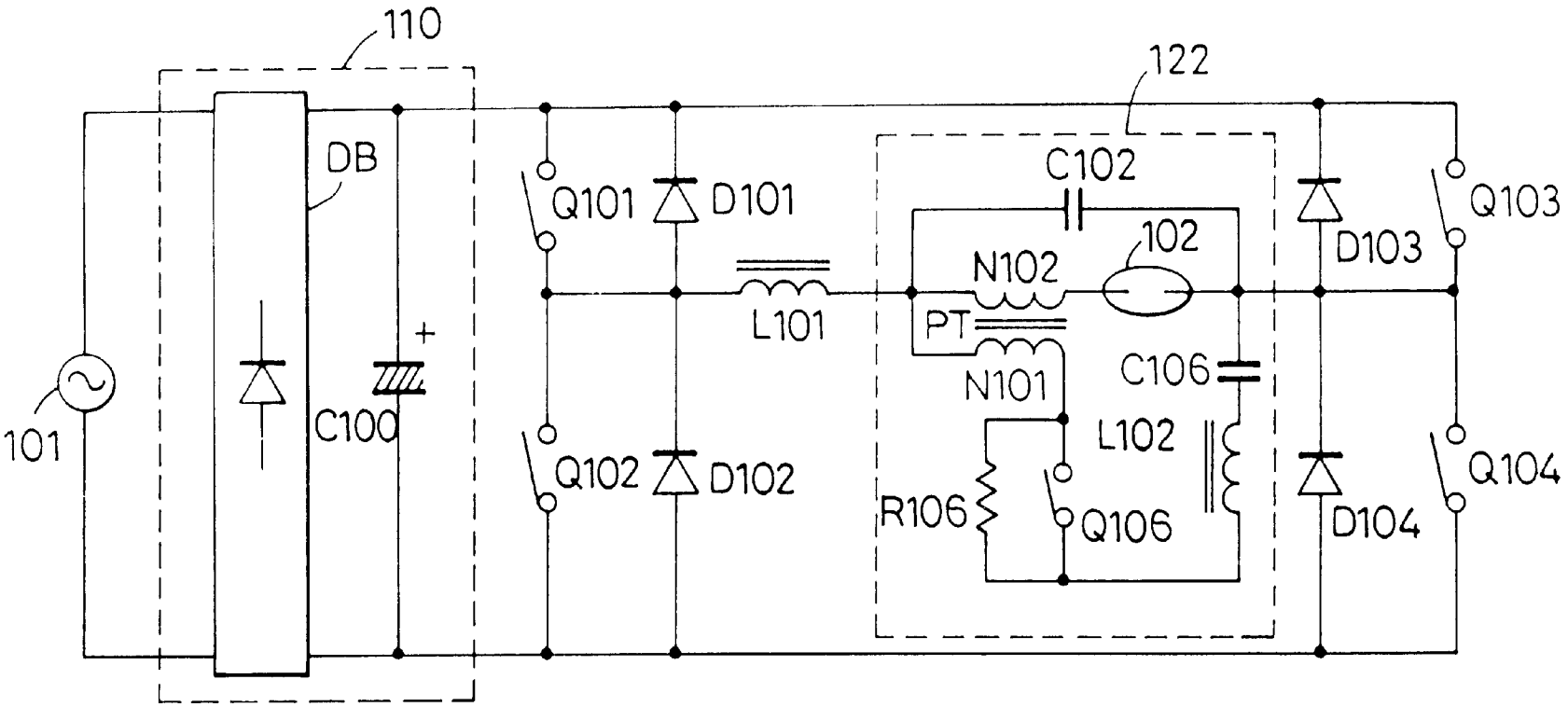
FIG. 21 is a circuit diagram of the seventh embodiment of the present invention.

FIG. 21 shows an eleventh embodiment wherein the discharge lamp start circuit 122 is arranged so that a sum of charging voltages developed across capacitors C106 and C102 causes turning ON a switching element Q106 to apply to the low-voltage side winding N101 of the pulse transformer PT a voltage roughly twice as high as the voltage of the foregoing embodiment.

Figure 22:
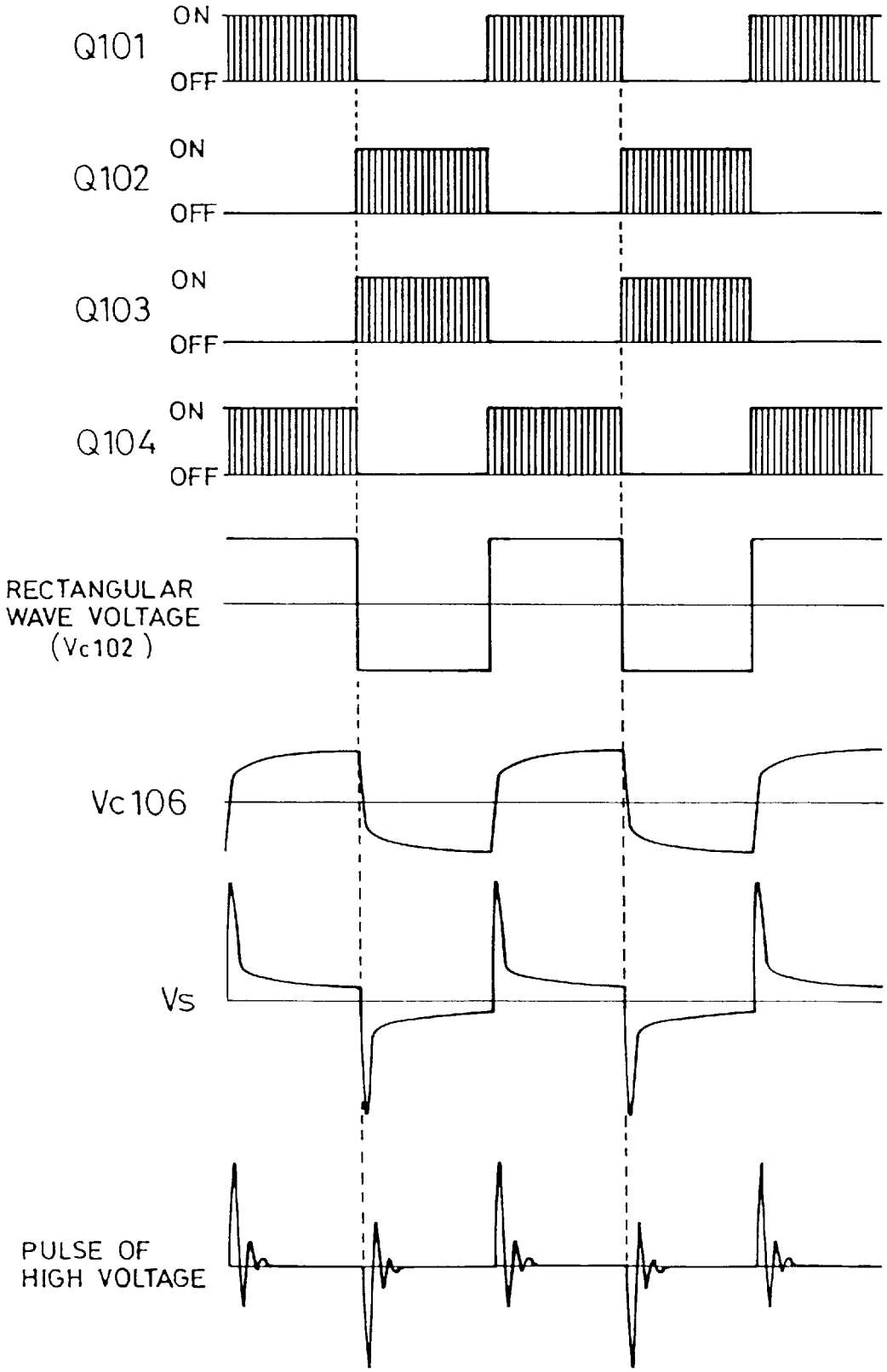
FIG. 22 shows waveforms of signal appearing in the seventh embodiment of FIG. 21.

Explanation will be made as to the operation of the above circuit system by referring also to FIG. 22 showing a waveform diagram. The switching elements Q101 to Q104 are operated so that the elements Q101 and Q104 or Q102 and Q103 diagonally arranged in pair are switched at a high frequency, as illustrated. Thus, a rectangular wave AC voltage applied to the discharge lamp start circuit 122 is as shown in the drawing. In this case, since the capacitor C102 is connected in parallel to input terminals of the discharge lamp start circuit 122, a voltage Vc102 applied to the capacitor C102 is the same as the rectangular wave AC voltage. Meanwhile, the capacitor C106 repeats its charging and discharging operations through the low-voltage side winding N101 of the pulse transformer PT, the resistor R106 and the inductor L102 to eventually generate such a waveform as shown by Vc106 in the drawing. A voltage applied to the switching element Q106 corresponds to a sum of voltages appearing across the capacitors C106 and C102. However, in a stable duration of the rectangular wave, the capacitors C106 and C102 have opposite polarities, so that the applied voltage corresponds to |Vc102|−|Vc106| that does not reach a breakover voltage of the switching element Q106, whereby the element Q106 will not be turned ON. At this time, when the polarity of the voltage Vc102 is inverted, the voltage Vc102 of the capacitor C102 is also inverted nearly at the same time, with the result that a voltage Vs of |Vc102|+|Vc106| as shown in the drawing is applied to the switching element Q106, that is, the voltage Vs reaches the breakover voltage of the switching element Q106, thus turning ON the switching element Q106. As a result, a pulse current flows through the low-voltage side winding N101 of the pulse transformer PT and thus such a high voltage pulse voltage as illustrated is induced in a high-voltage side winding N102. In the aforementioned circuit system, since a voltage roughly twice as high as the rectangular wave voltage can be applied to the low-voltage side winding N101 of the high-voltage pulse transformer PT, the pulse transformer PT can be made smaller in size than the foregoing circuit system.

Although the lamp lighting section has comprised the full bridge circuit in the present embodiment, the lighting section may be made up of the voltage step-down chopper circuit section and polarity inverting circuit section as to already explained in the embodiment 10. Similarly, the lighting section may comprise such a half bridge circuit as mentioned in the embodiment 10.

Figure 23:
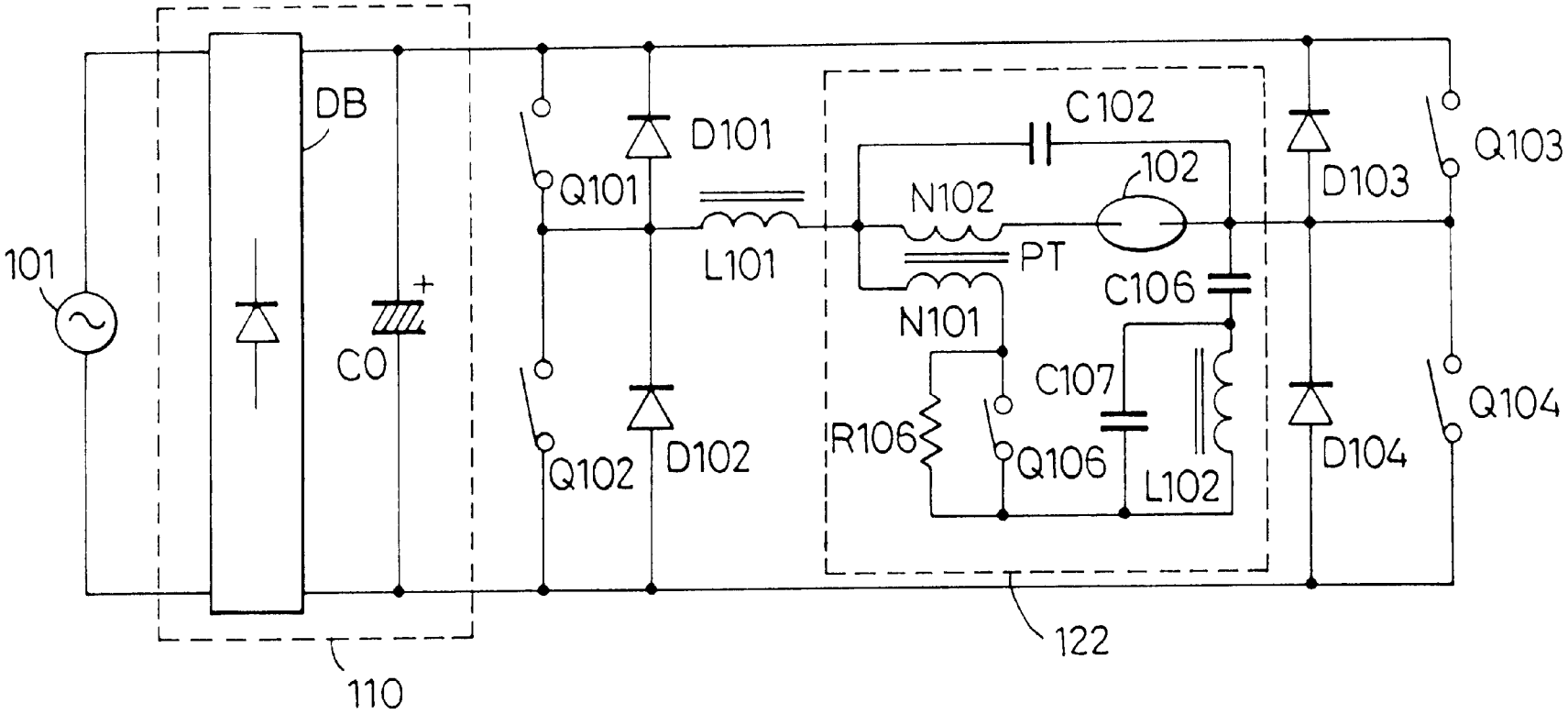
FIG. 23 is a circuit diagram of the eighth embodiment of the present invention.
Figure 24:
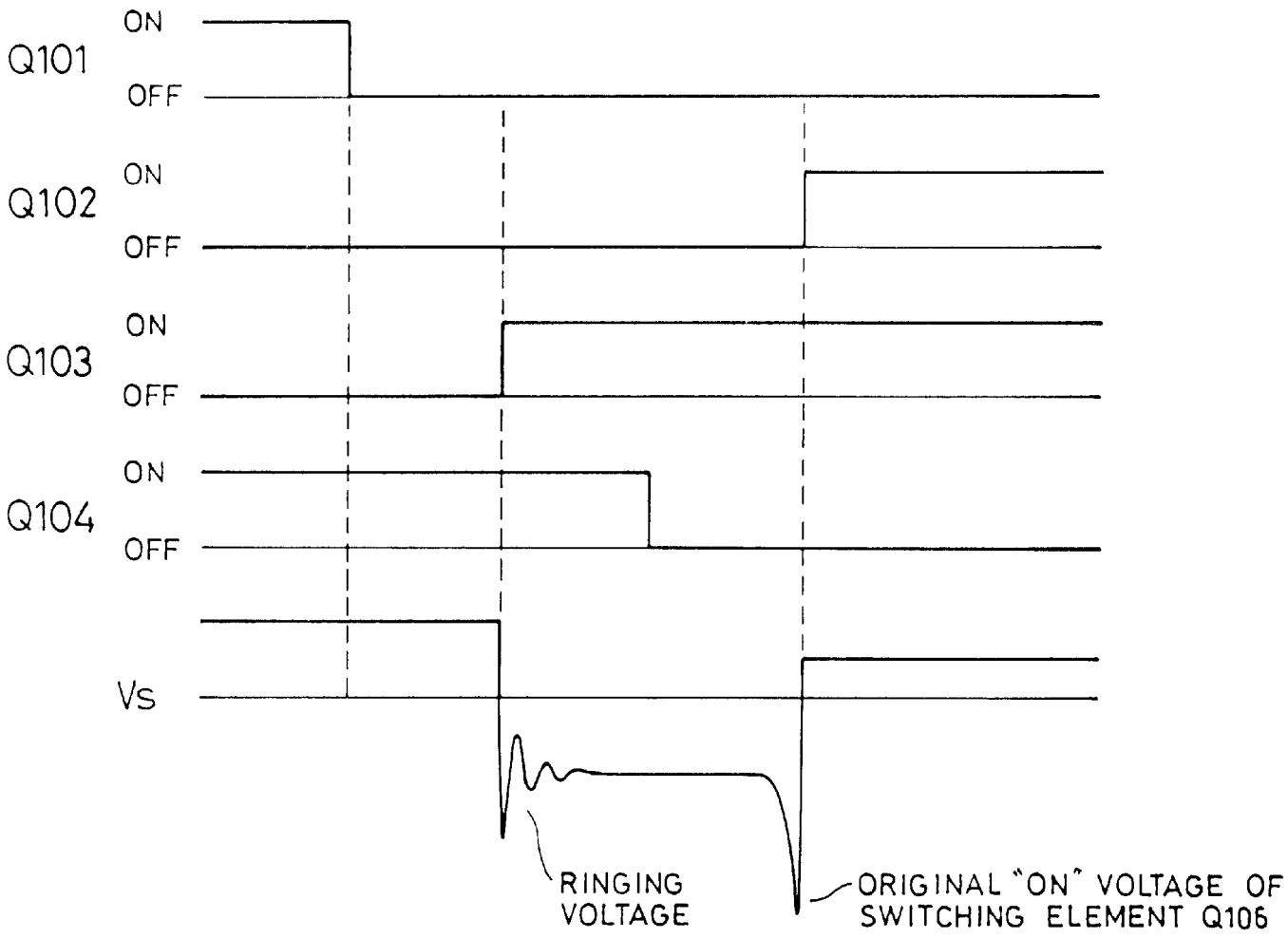
FIG. 24 shows waveforms of signals for explaining a problem to be solved by the eighth embodiment of FIG. 23.

FIG. 23 shows a twelfth embodiment. In the foregoing embodiment 11, there is present a problem which follows. The problem occurs when the polarities are inverted, the switching elements Q101 or Q103 connected to the higher potential side of a first switching element pair diagonally arranged is first turned OFF and then the switching element Q102 or Q104 from a second pair connected to the lower potential side is turned ON, after which the switching element Q104 or Q102 from the first pair connected to the lower potential side is turned OFF and then the switching element Q103 or Q101 connected to the higher potential side is turned ON. Assume now that, for example, the switching element pair Q101 and Q104 is in their ON state. Next the polarity inversion causes the switching element Q101 to be turned OFF and the switching element Q102 to be turned ON. Then since the switching elements Q102 and Q104 connected to the lower potential side are both turned ON, a closed loop is established in the low-voltage side of the bridge circuit. In the closed loop, due to LC resonance oscillation caused by the capacitor C106, the inductor L102, the stray capacitance contained in the inductor L102, the parasitic capacitance of the switching element Q106, the low-voltage side winding N101 of the pulse transformer PT and the inductor L101; such a ringing voltage as shown in FIG. 24 is inevitably applied to both ends of the switching element Q106. This circuit system is usually arranged so that a breakover voltage Vbo of the switching element Q106 satisfies a relationship of |Vc106|<Vbo<|Vc102|+|Vc106|, whereby, only when the polarities of the rectangular wave voltage are inverted, the switching element Q106 is turned ON. At this time, if such a ringing voltage as shown in FIG. 24 is applied to the switching element Q106, the switching element Q106 is undesirably turned ON at this point, by which the charge stored in the capacitor C106 to be undesirably discharged. In this case, the voltage applied to the low-voltage side winding N101 of the pulse transformer PT is only Vc102 that is lower than the original |Vc102|+|Vc106| and reduces the peak value of the high pulse voltage.

Figure 25:
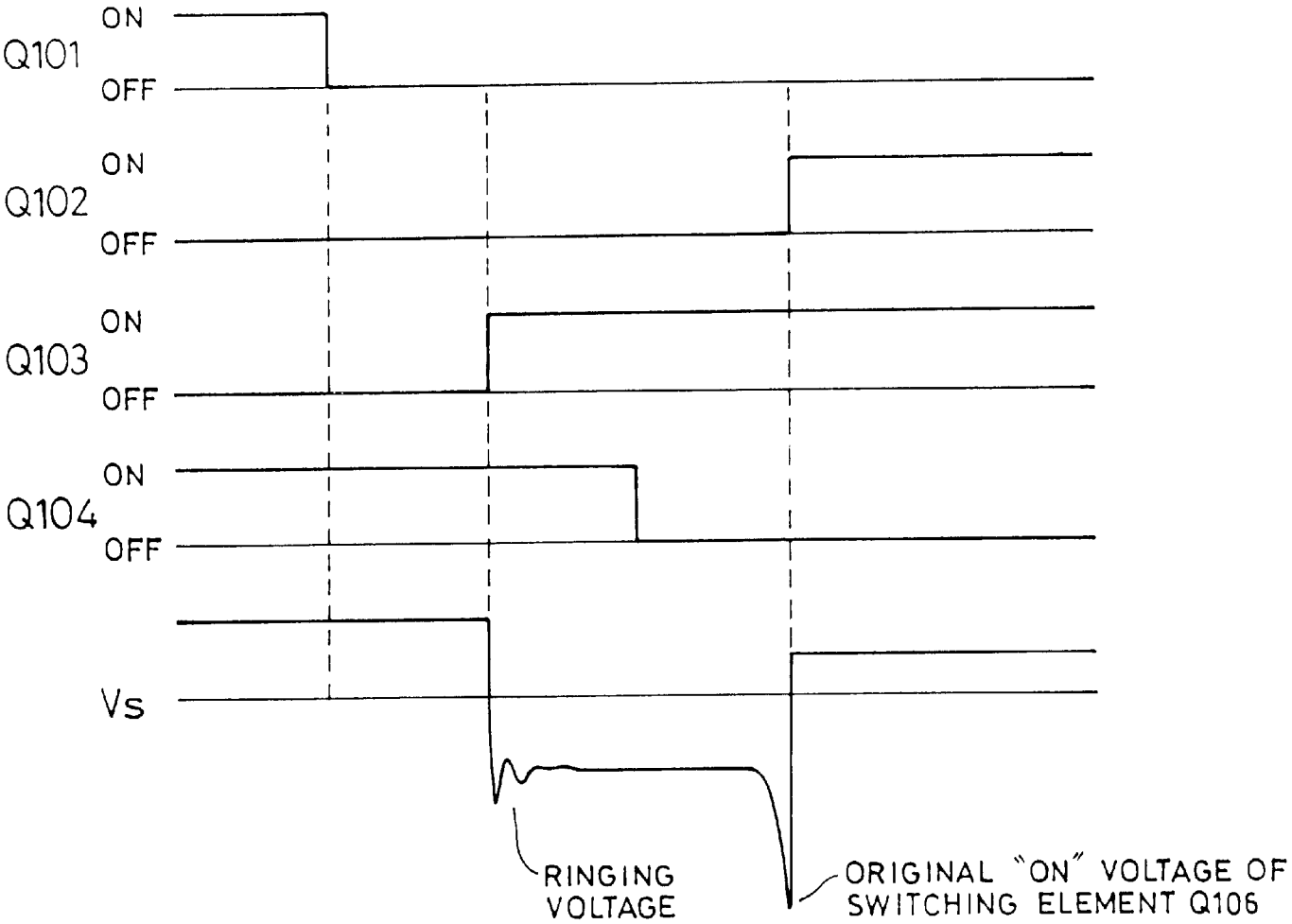
FIG. 25 shows waveforms of operational signals in the eighth embodiment of FIG. 23.

In the present embodiment, a capacitor C107 is connected in parallel to the inductor L102 to prevent application of an abnormal ringing voltage across the switching element Q106 even when the switching elements connected to the lower potential side are simultaneously turned ON at the time of the polarity inversion, thus realizing generation of a predetermined high pulse voltage. That is, in view of the fact that the stray capacitance of the inductor L102 partly contributes to the resonance frequency of the ringing voltage, the capacitor C107 is connected in parallel to the inductor L102 to reduce the resonance frequency (also refer to FIG. 25).

Figure 26:
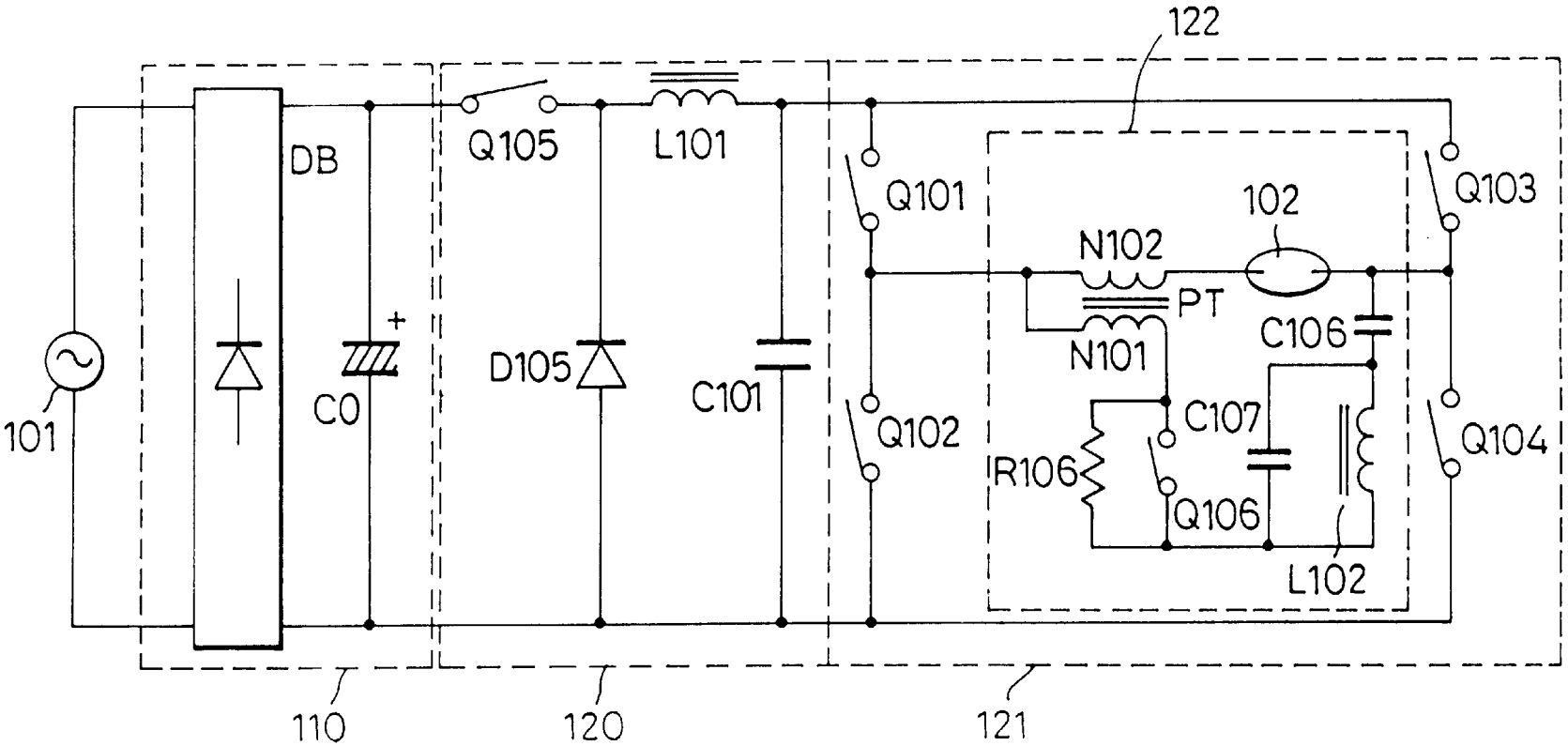
FIG. 26 is a circuit diagram of a modification of the eighth embodiment of FIG. 23.

Although explanation has been made in connection with the lamp lighting section comprising the full bridge circuit in the present embodiment, the lighting section may be a combination of the voltage step-down chopper circuit section 120 and polarity inverting circuit section 121 as shown in FIG. 26, exhibiting substantially the same effects as the above.

In the foregoing embodiments 5 to 12, reference has been made to only part of the discharge lamp lighting device without referring to its overall detailed circuit diagram. However, it will be readily appreciated that, when the present invention is applied to an actual discharge lamp lighting device for example, the arrangements of FIGS. 10 to 12 may be employed like the foregoing embodiments 1 to 4.

What is claimed is:

1. A discharge lamp lighting device comprising:

a ballast connected to a power source and containing at least a current limiting element;

a discharge lamp requiring a high pulse voltage at least at the time of starting the discharge lamp; and a discharge lamp start circuit, wherein said ballast, said discharge lamp and a high-voltage side winding of a transformer for generation of the high pulse voltage are present in a closed circuit, said discharge lamp start circuit including a first capacitor arranged to repetitively perform its charging/discharging operations based on an output of said ballast, a series circuit of at least a switching element and a low-voltage side winding of said transformer connected in parallel to said first capacitor, and a second capacitor is connected in parallel to the low voltage side winding of said transformer, an inductor connected in series with the low-voltage side winding of said transformer, and a series circuit of the low-voltage side winding of the transformer and inductor connected in parallel to said second capacitor.

2. A discharge lamp lighting device as set forth in claim 1, wherein said inductor is set to suppress a current flowing through the second capacitor in a glow discharge mode of said discharge lamp and to maintain a voltage level and pulse width necessary for starting the discharge lamp.

3. A discharge lamp lighting device as set forth in claim 1, wherein other parts are mounted on a printed circuit board not to be present in said closed circuit of said inductor, said second capacitor and said low-voltage side winding of said transformer.

4. A discharge lamp lighting device as set forth in claim 1, further comprising an inverter circuit section which includes said DC power source, at least one switching element, a diode, a first inductor and the first capacitor and supplies rectangular wave AC power to said discharge lamp, and wherein, in said discharge lamp start circuit, a series circuit is made up of at least one voltage-responsive switching element, a second inductor, the second capacitor and the low-voltage side winding of said transformer for generation of a high pulse voltage, said series circuit is connected to an output terminal of said inverter circuit section so that, at the time of inverting output polarities, a sum of charging voltages across said first and second capacitors causes said voltage-responsive switching element to be turned ON to apply the high pulse voltage to the discharge lamp from a high-voltage side winding for generation of the high pulse voltage connected in series with the discharge lamp.

5. A discharge lamp lighting device as set forth in claim 4, wherein said inverter circuit section comprises a polarity inverting circuit section which includes a voltage step-down chopper circuit part for converting a DC power to a voltage necessary for said discharge lamp and at least 4 switching elements, 2 of the 4 switching elements connected to a lower potential side of said polarity inverting circuit section are both simultaneously turned ON at the time of polarity inversion, a third capacitor is connected in parallel to a second inductor in said discharge lamp start circuit.

6. A discharge lamp lighting device comprising:

a discharge lamp requiring application of a high pulse voltage thereto at least at the time of starting said discharge lamp; and a discharge lamp start circuit having an inverter circuit section for generating the high pulse voltage necessary at the time of starting the discharge lamp, and wherein said inverter circuit section includes a DC power source, at least one switching element, a diode, a first inductor and a first capacitor and supplies a rectangular wave AC power to the discharge lamp, and wherein, in said discharge lamp start circuit, a series circuit is made up of at least one voltage-responsive switching element, a second inductor, a second capacitor and a low-voltage side winding of a transformer for generation of a high pulse voltage, said series circuit is connected to an output terminal of said inverter circuit section so that, at the time of inverting output polarities, a sum of charging voltages across said first and second capacitors causes said voltage-responsive switching element to be turned ON to apply the high pulse voltage to the discharge lamp from a high-voltage side winding for generation of the high pulse voltage connected in series with the discharge lamp, said inverter circuit section includes a voltage step-down chopper circuit part for converting a DC power to a voltage necessary for the discharge lamp and a polarity inverting circuit part having at least 4 switching elements, 2 of said 4 switching elements connected to the lower potential side of said polarity inverting circuit part are both simultaneously turned ON at the time of polarity inversion, a third capacitor is connected in parallel to said second inductor in said discharge lamp start circuit, said discharge lamp is a metal halide high-pressure discharge lamp, said high-pressure discharge lamp has a rating of either one of an M98 (70 W) and an M130 (35 W) based on ANSI specifications and has a ceramic light emitting tube.

* * * * *